US012594450B2

(12) United States Patent
Bluman et al.

(10) Patent No.: US 12,594,450 B2
(45) Date of Patent: Apr. 7, 2026

(54) MOTOR FUNCTION REHABILITATION SYSTEM AND METHOD

(71) Applicant: BIOXTREME LTD., Petah Tikva (IL)

(72) Inventors: Nini Bluman, Hulda (IL); Alon Goldstein, Hertzliya (IL)

(73) Assignee: BIOXTREME LTD., Petah Tikva (IL)

( * ) Notice: Subject to any disclaimer, the term of this patent is extended or adjusted under 35 U.S.C. 154(b) by 51 days.

(21) Appl. No.: 18/578,256

(22) PCT Filed: Jul. 11, 2022

(86) PCT No.: PCT/IL2022/050747

§ 371 (c)(1),
(2) Date: Jan. 10, 2024

(87) PCT Pub. No.: WO2023/286055

PCT Pub. Date: Jan. 19, 2023

(65) Prior Publication Data

US 2024/0299795 A1 Sep. 12, 2024

Related U.S. Application Data

(60) Provisional application No. 63/225,717, filed on Jul. 26, 2021.

(30) Foreign Application Priority Data

Jul. 12, 2021 (RU) ..... 2021120446

(51) Int. Cl.
*A63B 21/00* (2006.01)
*A63B 21/005* (2006.01)
(Continued)

(52) U.S. Cl.
CPC .... *A63B 21/00181* (2013.01); *A63B 21/0058* (2013.01); *A63B 21/4019* (2015.10); *A63B 24/0006* (2013.01); *A63B 2022/0094* (2013.01)

(58) Field of Classification Search
CPC ..... A63B 21/00181; A63B 21/0058; A63B 21/4019; A63B 24/0006;
(Continued)

(56) References Cited

U.S. PATENT DOCUMENTS 10,603,542 B1 * 3/2020 Smyser ..... A63B 21/002
2009/0221407 A1 * 9/2009 Hauk ..... A63B 21/0615 482/92

(Continued)

FOREIGN PATENT DOCUMENTS

CN 109475460 3/2019
EP 3132784 2/2017

(Continued)

OTHER PUBLICATIONS

Marchal-Crespo Laura et al: "Experimental Evaluation of a Mixed Controller That Amplifies Spatial Errors and Reduces Timing Errors", Frontiers in Robotics and AI, vol. 4, Jun. 22, 2017, pp. 1-16.

(Continued)

*Primary Examiner* — Sahlu Okebato
(74) *Attorney, Agent, or Firm* — Maschoff Brennan

(57) ABSTRACT

System and method for use in improving individual's motion ability are disclosed. A force applying device is used to apply a force to at least portion of the individual's body during an exercise performed by the individual. A sensing system monitors one or more training sessions of the exercise performed and selectively generate first measurement data comprising error-related data and second measurement data indicative of adaptive response of the individual to the force applied to the exercised body portion. A force controller can be used to manage operation of the force applying device according to operational data, such that the force being applied to the exercised body portion includes at least one of an interfering force segment or an assistive force (Continued)

segment, determined in accordance with a predetermined range of an error regulating profile.

24 Claims, 5 Drawing Sheets

(51) Int. Cl.
*A63B 24/00* (2006.01)
*A63B 22/00* (2006.01)

(58) Field of Classification Search
CPC ..... A63B 2022/0094; A63B 21/4035; A63B 2024/0009; A63B 2071/0072; A63B 2220/30; A63B 2220/51; A63B 2225/50; A63B 2024/0093; A63B 2220/58; A63B 23/1209; A63B 24/0087; A63B 71/0054; A63B 21/4021; A63B 2022/0092; A63B 2220/10; A63B 2220/40; A63B 2220/806; A63B 2225/20; A63B 2230/605; A63B 21/4043
See application file for complete search history.

(56) References Cited

U.S. PATENT DOCUMENTS

| | | | | |
|---|---|---|---|---|
| 2010/0298097 | A1* | 11/2010 | Preumont ..... | A63B 21/0056 482/44 |
| 2016/0166454 | A1 | 6/2016 | Johnson | |
| 2017/0326018 | A1 | 11/2017 | Courtine | |
| 2019/0021929 | A1 | 1/2019 | Einav | |
| 2019/0160337 | A1 | 5/2019 | Otsuki | |
| 2020/0139187 | A1* | 5/2020 | Kennington ..... | A63B 71/0622 |
| 2020/0306584 | A1 | 10/2020 | Hyung | |

FOREIGN PATENT DOCUMENTS

| | | |
|---|---|---|
| JP | 2019092928 | 6/2019 |
| RU | 198472 U1 | 7/2020 |
| WO | 2004096501 | 11/2004 |

OTHER PUBLICATIONS

Givon-Mayo Ronit et al: "A preliminary investigation of error enhancement of the velocity component in stroke patients' reaching movements", International Journal of Therapy and Rehabilitation, vol. 21, No. 4, Apr. 2, 2014 (Apr. 2, 2014), pp. 160-168.
Abdollahi F et al: "Arm control recovery enhanced by error augmentation", Rehabilitation Robotics (ICORR), 2011 IEEE International Conference on, IEEE, Jun. 29, 2011 (Jun. 29, 2011), pp. 1-6.
J. L. Patton et al, ("Custom-designed haptic training for restoring reaching ability to individuals with poststroke hemiparesis", Journal of Rehabilitation Research & Development—JRRD vol. 43, No. 5, pp. 643-656 Aug./Sep. 2006).
S. Israely at al, ("Improvement in Hand Trajectory of Reaching Movements by Error-Augmentation", Adv. Exp. Med Biol. 2018; 1070:71-84).
U.S. Appl. No. 63/367,260 of Jun. 29, 2022.

* cited by examiner

MOTOR FUNCTION REHABILITATION SYSTEM AND METHOD

TECHNOLOGICAL FIELD

The present invention is generally in the field of motor function rehabilitation, such as carried out by robot-assisted motor rehabilitation systems.

BACKGROUND

Motor impaired patients suffering from insufficient limb functions/coordination (e.g., post-stroke deficits) typically experience significant difficulties in carrying out simple every-day motoric tasks. As these motoric difficulties can affect all aspects of life and become permanent, there is a need to quickly treat and rehabilitate such patients as fast as possible. Feedback is an important factor in training/treating motor impaired patients, as it can be used to rate performance/quality of tasks carried out by the patient during treatment/training. For example, robot-assisted rehabilitation/therapy provides advanced techniques to train and improve motoric functioning of motor impaired patients. Such robot-based rehabilitation systems can accurately measure motoric performance (e.g., trajectory, speed, acceleration) of patients, and follow dedicated training protocols designed to improve daily performance of motoric tasks, and thereby improve the patient's cope with regular daily activities.

Motor impairments treatments may utilize error augmentation (also known as error enhancement) techniques, wherein the patient's motion errors are temporarily magnified by forces, to stimulate application of corrective forces by the trained patient. The enhancement of the patient's kinematic errors promotes production of neural signals that stimulate motor adaptation and learning. Error augmentation techniques are attractive to implement in robot-assisted treatment systems, which can be configured to accurately measure the patient's motion and deviations thereof from a desired trajectory and/or speed/acceleration profiles, and accordingly devise activities incorporating application of error augmented forces, for stimulating patients' corrective responses. Patients treated with robotic systems employing error augmentation schemes demonstrated improved performance of motoric tasks.

Few studies examining robot-assisted treatment techniques are briefly described hereinbelow to provide background information concerning the present application, which is not necessarily prior art.

R. Givon-Mayo et al, ("A preliminary investigation of error enhancement of the velocity component in stroke patients' reaching movements. International". Journal of Therapy and Rehabilitation, 2014; 21(4): 160-168) examined a new robot-assisted rehabilitation method for ameliorating arm reaching movements through velocity error enhancement training. Several clinical and kinematic measures were used in this study to evaluate outcomes. In this study a control group undertook reaching tasks over the same period while they were connected to the robot but without it applying any error enhancement forces to their upper limb. The robotic system was programmed such that deviations from optimal trajectory and velocity profile mean encountered error enhancing external forces. After 5 weeks of velocity error enhancement treatment, all participants in the experimental group displayed movements converging towards their optimal profiles together with decreased variability in their path trajectory.

F. Abdollahi et al, ("Arm control recovery enhanced by error augmentation", 2011 IEEE International Conference on Rehabilitation Robotics, 1-6) presents results where nineteen stroke survivors with chronic hemiparesis simultaneously employed the trio of patient, therapist, and machine. Massed practice combined with error augmentation, where haptic (robotic forces) and graphic (visual display) distortions are used to enhance the feedback of error, was compared to massed practice alone. In a 6-week randomized crossover design of 60 minutes daily treatment three times per week for two weeks, a therapist provided a visual target using a tracking device that moved a cursor in front of the patient, who was instructed to maintain the cursor on the target. The patient, therapist, technician-operator, and rater were blinded to treatment type. Results showed incremental benefit across most but not all days, abrupt gains in performance, and a benefit to error augmentation training in final evaluations.

J. L. Patton et al, ("*Custom-designed haptic training for restoring reaching ability to individuals with poststroke hemiparesis*", Journal of Rehabilitation Research & Development—JRRD Volume 43, Number 5, Pages 643-656 August/September 2006) present an initial test of a technique for retraining reaching skills in patients with post-stroke hemiparesis, in which errors are temporarily magnified to encourage learning and compensation. Individuals with poststroke hemiparesis held a horizontal plane robotic manipulandum that could exert a variety of forces while recording patients' movements. Patients' movement straightness recovery in a single visit to the laboratory (~3 h) was measured. Following training, forces were returned to zero for an additional 50 movements to discern if aftereffects lasted. All subjects showed immediate benefit from the training, although 3 of the 10 subjects did not retain these benefits for the remainder of the experiment.

S. Israeli at al, ("*Improvement in Hand Trajectory of Reaching Movements by Error-Augmentation*", Adv. Exp. Med Biol. 2018; 1070:71-84) investigate whether adaptive responses to error-augmentation force fields, would decrease the trajectory errors in hand-reaching movements in multiple directions in healthy individuals. The study was conducted, as a randomized controlled trial, in 41 healthy subjects. The study group trained on a 3D robotic system, applying error-augmenting forces on the hand during the execution of tasks. The control group carried out the same protocol in null-field conditions. A mixed-model ANOVA was implemented to investigate the interaction between groups and time, and changes in outcome measures within groups. The findings were that there was a significant interaction effect for group×time in terms of the magnitude of movement errors across game-sets. The trajectory error of the study group significantly decreased from 0.035±0.013 m at baseline to 0.029±0.011 m at a follow-up, which amounted to a 14.8% improvement.

GENERAL DESCRIPTION

There are many difficulties associated in adapting error enhancement schemes for motor therapy treatment of patients. A certain error enhancement protocol designed to match conditions and/or impairment of a specific patient is unlikely to be suitable for treating other patients with different conditions/impairments, or even patients suffering from the same impairment. Accordingly, a unique error enhancing protocol should be tailored for each patient according to the individual's specific characteristics e.g., physical condition, type of impairment, age, weight, height, sex, motoric abilities, adaptive response, etc.

The present application discloses techniques for adaptively constructing an error regulating protocol for a specific patient for matching the protocol to the patient's specific characteristics and abilities utilizing a motion therapy system. Also disclosed herein techniques for initial and continuous diagnosis of the effectiveness of motor therapy treatments employing error enhancement and/or correction function(s) (generally referred to herein as error regulation functions/profiles) specifically tailored for each patient, thereby allowing initial screening or discontinuation of ineffective treatment(s).

The techniques disclosed herein are useful for, but not restricted to, robot-assisted motor rehabilitation systems in which an exercised body portion (e.g., a limb) of the patient is coupled to a robotic arm system. The system can be configured to manipulate the robotic arm system for applying assisting or interfering forces over the exercised body portion during the exercises thereby performed. The motor therapy techniques hereof are configured to adaptively construct an error regulation function/profile to a specific patient based on characterizing information of the patient indicative of the patient's condition, and/or measurement data indicative of the patient's performance and progress, which is collected during exercise sessions conducted by the patient.

The error regulating function/profile constructed for the patient can have at least one error enhancement portion in which error augmenting forces (also referred to herein as interfering forces) are applied in real-time by the motion therapy system to interfere in the movements performed by the patient, and optionally at least one error correction portion in which error correcting forces (also referred to herein as assisting forces) are applied in real-time by the motion therapy system to attenuate the errors/deviations in the movements performed by the patient.

One or more sensors can be used in the motion therapy system for generating measurement data/signals indicative of the movements performed, and/or forces applied, by the exercised body portion during the exercises performed. The measurement data is used to determine motion patterns/trajectories performed by the exercised body portion during the exercise, and/or forces thereby applied therealong. The determined motion patterns/trajectories and/or forces (and optionally time profiles associated therewith) are compared to expected motion patterns/trajectories and/or forces (and optionally respective expected time profiles associated therewith) to determine errors/deviations of the movements performed by the patient from the expected performance. The determined errors/deviations are then used to adapt parameters of the error regulating function/profile to better match the patient's capabilities.

In some embodiments the motor therapy system is configured and operable to perform one or more preliminary exercises in which the patient performs various movements with the exercised body portion while interfering or assistive forces are applied thereon by the robotic arm system. The measurement data obtained from the one or more preliminary exercises is processed and analyzed to determine therefrom a maximal applicable force parameter for the error regulating function/profile to be used by the system during the exercises thereby performed with the patient. Other parameters of the error regulating function/profile can be also adjusted based on the determined errors/deviations.

For example, one or more error ranges can be determined to define one or more error enhancement portions, and/or error correction portions, of the error regulating function/profile in which a constant force e.g., the determined maximal applicable force parameter, is to be applied by the system over the exercised body portion. One or more other error ranges of respective one or more dead/free band portions can be determined for the error regulating function/profile, in which no force is to be applied to the exercised body portion during the exercise sessions. At least one of the dead/free band portions can be defined for errors/deviations that are very small and/or negligible. One or more other dead/free band portions can be used in the error regulating function/profile for transitions of the error regulating function/profile from an error enhancement portion to an error correction portion, and vice versa.

The system can define an error range for transition portion from a dead/free band portion to an error enhancement portion, or to an error correction portion, of the error regulating function/profile. In the transition portion the forces applied by the system are progressively changed from the a zero force applied by the system in the dead/free band portion towards the constant force applied by the system in the error enhancement portion, or in the error correction portion, and vice versa. The forces applied by the system in the transition portion can be monotonically increasing, or monotonically decreasing, error enhancement or correction forces, depending on the direction of the transition. In possible embodiments, however, the forces applied by the system in the transition portions can exhibit quadratic, polynomial, incremental/decremental step-shape, or non-linear patterns along the error axis.

After setting the different parameters of the error regulating function/profile one or more patient exercise sessions can be conducted by the system without the error regulating function/profile i.e., without applying error enhancement or correction forces, and a respective average error is determined for exercising the body portion without application of regulating forces based on the measurement data obtained. One or more parameters of the error regulating function/profile can be adjusted based on the determined average error for exercise without application of error regulating forces e.g., a maximal or minimal error enhancement or correction force value, one or more dead/free band error ranges, and/or one or more error ranges for applying the error enhancement or correction force(s).

A determined set of exercise sessions can be then conducted utilizing the error regulating function/profile with the application of error regulating forces. For each exercise session performed with the application of error regulating forces a respective average error is determined, and one or more parameters of the error regulating function/profile can be then accordingly adjusted. For example, in some embodiments the maximal (and/or a minimal) applicable force parameter of the error regulating function/profile is scaled up, or down, based on the average error determined for exercising the patient with the error regulating forces. Optionally, but in some embodiments preferably, after each exercise session conducted by the patient with the application of the error regulating forces the maximal (and/or a minimal) applicable force parameter of the error regulating function/profile is scaled down (or up), and the newly determined average error for exercising with error regulating forces is used to determine the progress of the patient. Additionally, or alternatively, one or more dead/free band error ranges, and/or one or more error ranges for applying the error enhancement, or correction, force(s) are adjusted after each exercise session conducted by the patient with the application of the error regulating forces.

The scaling up, or down, of the maximal applicable force parameter of the error regulating function/profile according to the patient performance in the various exercises thereby performed with the motor therapy system, is designed to determine an optimal maximal applicable force value for the specific patient. The optimal maximal applicable force value determined for the patient can be then used as the the constant force applied by the system in the error enhancement, or correction, portions, of the error regulating function/profile thereby used. By adaptively setting a dedicated optimal maximal applicable force value over consecutive training sessions of a specific treated patient, a continuous amelioration process is created, that can be memorized by the patient as the patient's body adaptively develops respective power regulation patterns required for carrying out the training exercises. The optimal maximal applicable force value determined for the patient in one or more treatment sessions can be used as a set point for future treatment session(s) to trigger the power regulation patterns memorized by the patient's body in the subsequent training sessions thereby performed.

Optionally, the adaptive setting of the dedicated optimal maximal applicable force value can be carried out by determining an initial minimal applicable force value for the training exercises carried out with the motion therapy system utilizing the error regulation function/profile, and after each exercise increasing the minimal applicable force value according to the performance and progress of the treated individual, until reaching a certain force level that is too difficult for the treated individual for the training. The optimal maximal applicable force value can be accordingly set in accordance with the certain force level that is too difficult for the treated individual.

If after conducting a predefined set of the exercise sessions with the error regulating forces no progress is indicated by the determined average error, the treatment of the patient is terminated for incompetence reasons. Otherwise, if progress is indicated by the average error determined for exercising with the error regulating forces, additional sets of exercise sessions are carried out with and/or without the application of error regulating forces, to further adjust parameters of the error regulating function e.g., the maximal applicable force parameter, and average error values for exercising with and/or without the error regulating forces.

Optionally, but in some embodiments preferably, the average error values are determined from sets of absolute error values indicative of deviations of discrete points along trajectories of motions performed by the patient in three-dimensional space during the exercise sessions from a desired trajectory associated with the training exercise being performed with the system. For example, the absolute error values can be determined from distances of the discrete (sample set) points along trajectories of motions performed by the patient in three-dimensional space during the exercise sessions performed. Alternatively, or additionally, the absolute error values can be determined from measured forces applied by the exercised body portion at discrete (sample set) points of time during the exercise sessions performed.

One inventive aspect of the subject matter disclosed herein relates to a system for use in improving individual's motion ability. The system comprises in some embodiments a force applying device configured and operable to controllably apply a force of a predetermined profile to at least portion of the individual's body during an exercise performed by the individual, a sensing system configured and operable to monitor one or more training sessions of the exercise performed by the at least portion of the individual's body and generate measurement data for the monitored training sessions, and a control system configured and operable for data communication with the sensing system and with the force applying device for operating the force applying device to controllably apply the force of the predetermined profile to the at least portion of the individual's body during the exercise based on the measurement data generated by the sensing system. The sensing system can be configured to generate the measurement data to selectively include a first measurement data comprising error-related data and second measurement data indicative of adaptive response of the individual to the force applied to the at least portion of the individual's body.

Optionally, but in some embodiments preferably, the first measurement data and/or the second measurement data is processed and analyzed to determine at least one error enhancement and/or error correction slope to be used in an error regulating function/profile of the system. For example, but without being limiting, one or more preliminary sessions can be carried out for acquiring one or more sets of the first and/or second measurement data for determining one or more average error values indicative of deviations made in the exercise(s) performed from a desired performance (e.g., trajectory), and respective one or more local maximal force values indicative of maximal forces applied by the treated individual during the performed exercise(s) and associated with the determined one or more average error values.

The system is configured in some embodiments to use at least one of the determined average error values and its respective local maximal force to determine a slope of at least one error enhancement function of the error regulation function/profile to be used in treatment sessions of the specific individual. Optionally, but in some embodiments preferably, the slope of at least one error enhancement function is determined from two or more average error values and their respective local maximal force values. The maximal applicable force parameter of the error regulation function/profile can be determined from at least one of the one or more local maximal force values. For example, the maximal applicable force parameter can be initially set as an average of the local maximal force values, or as an extremum (minimum or maximum) of the local maximal force values. The maximal applicable force parameter of the error regulation function/profile can be adjusted over time as increasing numbers of treatment sessions utilizing the error regulation function/profile are carried out by the treated individual, and corresponding additional average error values and their respective local maximal force values are aggregated.

The control system comprises in some embodiments: a force controller configured to manage operation of the force applying device according to operational data such that the profile of the force being applied to the body portion includes at least one interfering force segment for which error enhancing forces are applied by the force applying device, and/or an assistive force segment, determined in accordance with a predetermined range of an error regulating profile/function; and an analyzer configured and operable to selectively perform the following: (i) provide force adjustment data indicative of a maximal applicable force value for the error regulating profile/function e.g., based at least partially on individual-related data in association with the exercise; (ii) analyze at least one of the first and second measurement data to determine data indicative of adjustment to the error regulating profile/function (e.g., maximal applicable force, error enhancement or correction slopes), and generate the operational data to the force controller. Optionally, a treatment session may be continuously, or repeatedly, performed until identifying a predetermined condition of the second measurement data indicative of the adaptive response of the individual to the applied force.

The analyzer is configured in some embodiments to determine based on the analyzed measurement data one or more average error values and respective one or more local maximal forces applied by the body portion of the individual, and determine based thereon at least one slope of an error-enhancing function or of an error-correcting function of the error regulating profile. The analyzer can be configured to access pre-stored data comprising the force adjustment data indicative of the maximal applicable force value for the error regulating profile/function, based on the individual-related data e.g., in association with the exercise. Additionally, or alternatively, the analyzer can be configured to analyze input data comprising the individual-related data (e.g., in association with the exercise) and determine based thereon the force adjustment data indicative of the maximal applicable force value for the error regulating profile/function. In possible applications the analyzer is configured to determine based on the analyzed measurement data an average error value, an optimal adaptive force response of the individual to the exercise thereby performed, and determine based thereon at least one slope of an error-enhancing function, or of an error-correcting function, of the error regulating profile.

The sensing system comprises in some embodiments at least one motion sensor device configured and operable to determine a motion pattern characterizing the individual's performance of the training session, and, upon identifying error in the motion pattern, measuring the error and generating the first measurement data comprising the error-related data. The at least one motion sensor device can be configured and operable to determine the motion pattern characterizing the individual's performance of the training session by monitoring at least one of the following: motion performed by the at least portion of the individual's body, and one or more parameters or conditions of an operative device being operated by the individual during the training session. Optionally, but in some embodiments preferably, the system comprises at least one of the following: a positioning sensor device; a velocity sensor device; an acceleration sensor device; a force sensor device, configured to determine patterns characterizing the individual's performance of the training session.

In some embodiments the sensing system comprises one or more sensors configured and operable to determine a response force of the body portion to the force being applied thereto and generate the second measurement data indicative of adaptive response of the individual. The one or more sensors of the sensing system can be configured and operable to directly measure the response force of the body portion to the force being applied thereto and/or measure the response force via its effect on one or more parameters or conditions of an operative device being operated by the individual during the training session.

The error regulating profile/function can comprise at least one of the following:

at least one error enhancing portion defining a range of error values associated with the exercise performed by the at least portion of the individual's body, for which error enhancing forces are applied by the force applying device;

at least one constant error enhancing range of the at least one error enhancing portion defining a sub-range of error values associated with the exercise performed by the at least portion of the individual's body, for which the error enhancing forces applied by the force applying device are constant;

at least one error correcting portion defining a range of error values associated with the exercise performed by the at least portion of the individual's body, for which error correcting forces are applied by the force applying device;

at least one constant error correcting range of the at least one error correcting portion defining a sub-range of error values associated with the exercise performed by the at least portion of the individual's body, for which the error correcting forces applied by the force applying device are constant;

at least one dead/free band portion defining a range of error values for which forces are not applied by the force applying device;

at least one transition portion defining a range of error values between the at least one dead band portion and the at least one error enhancement portion of the error regulating profile/function, for which the forces applied by the force applying device are progressively changed in accordance with the transition between the dead band and error enhancement portions;

at least one transition portion defining a range of error values between the at least one dead band portion and the at least one error correcting portion of the error regulating profile/function, for which the forces applied by the force applying device are progressively changed in accordance with the transition between said dead band and error correction portions;

at least one control function defining an attenuation profile for the error regulating profile/function in accordance with relative progress (along the training trajectory) of movement performed by the at least portion of the individual's body.

Optionally, at least one of the at least one error enhancing portion, the at least one constant error enhancing range, the at least one error correcting portion, the at least one constant error correcting range, the at least one dead band portion, the at least one transition portion, and/or the at least one control function, is determined by the analyzer based on measurement data, and/or the individual-related data, and/or based on user's data inputs.

The system can comprise a database for storing individual-related data, and/or the force adjustment data, and/or the error regulating profile/function.

The force applying device comprises in some embodiments a robotic arm system configured for allowing movement of a hand of the treated individual in at least one of up-down, left-right, and forward-backward, directions. A supporting tray can be coupled to a free end of the robotic arm system and configured to support palmar medial side of the hand of the treated individual. A handgrip device can be coupled to the supporting tray and configured for gripping by the palm and fingers of the hand of the treated individual, to thereby facilitate exercise performance by motor impaired individuals. The handgrip device can be a treatment device configured to exercise hand function of the hand of the treated individual (e.g., hand/finger-grip and/or hand/finger-expand), such as described and illustrated in U.S. Provisional patent application No. 63/367,260 of 29 Jun. 2022, of the same Applicant hereof, the content of which is incorporate herein by reference.

A force sensor is used in some embodiments to measure forces operating/evolving between the exercised body portion of the treated individual and the robotic arm (e.g., between the arm/hand of the treated subject and the handgrip device and/or the supporting tray). The force sensor can be configured to connect the handgrip device and/or the supporting tray to the free end of the robotic arm system. Optionally, and in some embodiments preferably, a grip sensor device is used in the handgrip device to sense grip strength of the palm and fingers of the treated individual over said handgrip device and generate data/signals indicative thereof. An immobilizing module can be used in the control system to halt operation of the system responsive to signals/data from the grip sensor device e.g., when the data/signals from the grip sensor device are indicative of a loose/weak grip of the hand of the treated individual over the handgrip device.

The system can comprise a gimbal-handpiece manipulator attached to the free end of the robotic arm system and configured to enable at least one of pitch, yaw and roll, motion by the handgrip device. A zero-gravitation module can be used in the control system to operate the force applying device to apply counter-gravitation forces over the free end of the robotic arm system.

Another inventive aspect of the subject matter disclosed herein relates to a method for use in improving individual's motion ability. The method comprises in some embodiments: determining force adjustment data e.g., based at least in part on individual-related data, the force adjustment data being indicative of a maximal applicable force value applicable to at least a portion of the individual's body for limiting error enhancing forces of a predetermined error regulating profile/function associated with an exercise performed by the individual; generating first measurement data comprising error-related data in association with the individual's performance of the exercise, and second measurement data indicative of adaptive response of the individual to the force applied to the at least portion of the individual's body during the exercise; and analyzing at least one of the first and second measurement data to determine data indicative of adjustment of a range of the error regulating profile/function and its maximal applicable force value, and generating operational data for effecting said error enhancing forces by a force applying device to apply the force in accordance with the error regulating profile/function. The treatment can be continuously, or repeatedly, carried out until identifying a predetermined condition of the second measurement data indicative of the adaptive response of the individual to the applied force.

The method comprises in some embodiments analyzing the measurement data and determining one or more average error values and respective one or more local maximal forces applied by the body portion of the individual, and determining based thereon at least one slope of an error-enhancing function or of an error-correcting function of the error regulating profile. The individual-related data can comprise at least one of physical condition, type of impairment, age, weight, height, sex, motoric abilities, adaptive response. In some applications the method comprises analyzing the measurement data and determining an average error value and an optimal adaptive force response of the individual to the exercise thereby performed, and determining based on the average error value and the optimal adaptive force response at least one slope of an error-enhancing function, or of an error-correcting function, of the error regulating profile.

The method comprises in some embodiments processing measurement data comprising error-related data in association with the individual's performance of an exercise performed under application of the error enhancing forces, and adjusting based thereon at least the maximal applicable force value of the error regulating profile/function. Alternatively, or additionally, the method comprises processing the measurement data comprising the error-related data in association with the individual's performance of an exercise performed without application of the error enhancing forces, and defining or adjusting based thereon at least one parameter of the error regulating profile/function e.g., the maximal applicable force value, and/or slope of an error enhancing or correcting function, of the error regulating profile/function.

The method can comprise defining or adjusting based on the processed measurement data at least one of the following:

- at least one error enhancing portion of the error regulating profile/function in which the error enhancing force is to be applied over the at least portion of the individual's body;
- at least one constant error enhancing range defining a sub-range of error values within the error enhancing portion in which a constant error enhancing force is to be applied over the at least portion of the individual's body;
- at least one error correction portion of the error regulating profile/function in which an error correcting force is to be applied over the at least portion of the individual's body;
- at least one constant error correction range defining a sub-range of error values within the error correction portion in which a constant error correcting force is to be applied over the at least portion of the individual's body;
- at least one dead/free band portion of the error regulating profile/function in which forces are not applied over the at least portion of the individual's body;
- at least one transition portion of the error regulating profile/function in which forces applied over the at least portion of the individual's body progressively change in accordance with changes of error values of the error-related data;

The determining of the constant error enhancing or correcting forces can be based on the determined maximal applicable force value.

Optionally, at least one dead/free band portion of the error regulating profile/function is defined for substantially small values of the error-related data. The at least one dead/free band portion of the error regulating profile/function can be defined between error enhancing and correction portions of the error regulating function.

In some embodiments at least one transition portion of the error regulating profile/function is defined between one of the dead band portions and one of the error enhancement or correction portions of the error regulating profile/function.

The method can comprise determining based on the error-related data an average error value for performance of the exercise without application of error regulating forces. The method can further comprise processing measurement data comprising error-related data in association with the individual's performance of an exercise performed with error regulating forces applied in accordance with the error regulating profile/function, and determining based thereon at least one of adaptive response of the individual and an average error value for performance of the exercise with application of error regulating forces. The method can further comprise adjusting the determined maximal applicable force value based on a comparison between the determined average error value for performance of the exercise with and without application of the error regulating forces.

In some embodiments the method comprises processing measurement data comprising error-related data in association with the individual's performance of a further exercise performed with error regulating forces applied in accordance with the error regulating profile/function, and determining based thereon at least one of adaptive response of the individual and an average error value for performance of the exercise with application of error regulating forces. The method can comprise repeating the processing of the measurement data comprising the error-related data in association with the individual's performance of the further exercise performed with the error regulating forces applied in accordance with the error regulating profile/function until either: (i) the determined adaptive response and/or average error value for performance of the exercise with application of the error regulating forces is indicative of a desired acceptable progress level in performance of the exercise; or (ii) a number of times the exercise performed with the application of the error regulating forces equals a predetermined number.

The method comprises in some embodiments defining a control function configured to progressively attenuate the error regulating forces applied to the at least portion of the individual's body during the exercise with respect to a distance from the body of the individual.

Yet another inventive aspect of the subject matter disclosed herein relates to a method for determining competence of an individual to a motor rehabilitation treatment. The method comprising providing an error regulating profile/function defining at least one interfering force segment in which error enhancing forces are applied over at least one body portion of the individual during performance of an exercise, and a maximal applicable force value limiting the error enhancing forces of the error regulating profile, measuring error-related data in association with the individual's performance of an exercise without application of the error regulating forces defined by said error regulating profile/function, and determining an average error value ($e_{Av-}$) for exercise performance without application of error regulating forces based thereon, measuring error-related data in association with the individual's performance of an exercise with application of the error regulating forces defined by the error regulating profile/function, and determining an average error value ($e_{AV+}$) for exercise performance with the application of error regulating forces based thereon, and determining the competence based on a relation ($e_{Av-}/e_{AV+}$) between the average error values determined for exercise performance with and without the error regulating forces.

The method comprises in some embodiments using the relation between the average error values determined for exercise performance with and without the error regulating forces to define a progress level of the individual in the exercise performance, and wherein the competence of said individual to the treatment is determined whenever said progress level is greater than some predefined acceptable progress level value ($1/\alpha$).

Optionally, but in some embodiments preferably, the method comprises measuring a plurality of the error-related data in association with a respective plurality of performances of the exercise by the individual with the application of the error regulating forces, determining a respective average error value for each of the plurality of exercise performances with the application of error regulating forces based on its respective measured error-related data, determining a respective progress level for each of the plurality of exercise performance based on the respective average error value with the application of error regulating forces and the average error value determined for exercise performance without the error regulating forces, and determining the competence of the individual to the treatment if at least one of the plurality of determined progress levels is greater than the predefined acceptable progress level value.

The error-related data is associated in possible embodiments with at least one of the following: deviation(s) of the at least one body portion from a desired trajectory during an exercise/session; and/or deviation(s) of forces applied by the at least one body portion from a desired force application profile during an exercise/session, and/or deviation(s) of velocities and/or accelerations of the at least one body portion from desired velocities and/or accelerations profiles during an exercise/session.

A yet other inventive aspect of the subject matter disclosed herein relates to a system for determining competence of an individual to a motor rehabilitation treatment, the system comprising: a force applying device configured and operable to controllably apply a force to at least portion of the individual's body during an exercise performed by the individual; a sensing system configured and operable to monitor one or more training sessions of the exercise performed by the at least portion of the individual's body and generate measurement data; and a control system configured and operable for data communication with the sensing system and with the force applying device, the control system comprising: a force controller configured to manage operation of the force applying device according to operational data such that the force being applied to the body portion includes at least one interfering force segment for which error enhancing forces are applied by the force applying device, determined in accordance with a predetermined error regulating profile/function; an analyzer configured and operable to selectively perform the following: determine from the measurement data error-related data associated with the individual's performance of the exercise without application of the error regulating forces defined by said error regulating profile/function; determine from the measurement data an average error value for exercise performance with application of the error regulating forces defined by said error regulating profile/function; and determine said competence based on a relation between the average error values determined for exercise performance with and without the error regulating forces.

In some embodiments the error-related data is associated with deviation of the at least portion of the individual's body from a desired trajectory during the exercise performed by the individual, and/or deviation of a force applied by the at least portion of the individual's body during the exercise from a desired force pattern, and/or deviation of velocities and/or accelerations of the individual's body during the exercise from desired velocities and/or accelerations patterns. The sensing system can be configured to generate the measurement data utilizing at least one of the following: a position sensor, accelerometer, a velocity meter, a camera (e.g., imager, video camera, or suchlike), a load cell, a pressure sensor, a strain gauge, ammeter configured to measure electric current of an electric motor in the force applying device, electromyograph (EMG), surface EMG, and/or intramuscular EMG.

A yet other inventive aspect of the subject matter disclosed herein relates to a system for training motor-impaired individuals, the system comprising: a force applying device having a robotic arm system configured and operable to controllably apply a force (e.g., in up-down, left-right, and forward-backward, directions) of a predetermined profile to a hand of the trained individual during an exercise performed by said individual; a gimbal-handpiece manipulator coupled to a free end of the robotic arm system for permitting at least one of pitch, yaw and roll motion during the exercise; a sensing system configured and operable to monitor one or more training sessions of the exercise performed by the hand of the trained individual and generate measurement data for the monitored training sessions; and a control system configured and operable for data communication with the sensing system and with the force applying device for operating the force applying device to controllably apply the force of the predetermined profile to the at least portion of the individual's body during the exercise based on the measurement data generated by the sensing system. The sensing and/or the control system can be configured to carry out any of the operations/functions described hereinabove and/or hereinbelow with respect to the different embodiments disclosed herein.

Yet another inventive aspect disclosed herein relates to a method for use in improving individual's motion ability that comprises: generating measurement data comprising error-related data in association with the individual's performance of an exercise and applied force data indicative of adaptive response of the individual to the exercise thereby performed; analyzing the measurement data to determine an average error value and an optimal adaptive force response of the individual to the exercise thereby performed; and determining based on the average error value and the optimal adaptive force response at least one slope of an error-enhancing function of an error regulating profile, and generating operational data for effecting error enhancing forces by a force applying device to apply the error enhancing forces within the range of the error regulating profile.

It is noted that embodiments hereof can be used, and may be highly relevant, for other potential applications utilizing error enhancement techniques, such as used in certain sport types, in military, aviation, etc.

BRIEF DESCRIPTION OF THE DRAWINGS

In order to understand the invention and to see how it may be carried out in practice, embodiments will now be described, by way of non-limiting example only, with reference to the accompanying drawings. Features shown in the drawings are meant to be illustrative of only some embodiments of the invention, unless otherwise implicitly indicated. In the drawings like reference numerals are used to indicate corresponding parts, and in which.

DETAILED DESCRIPTION OF EMBODIMENTS

Figure 1:
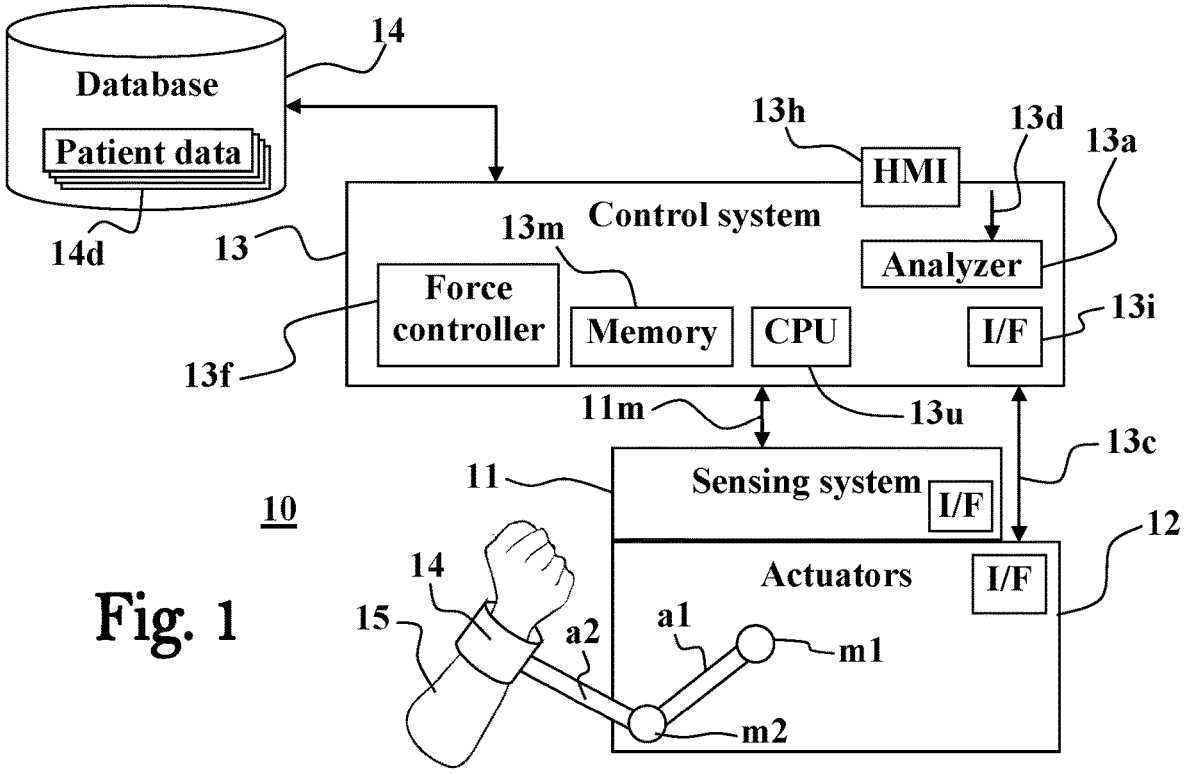
FIG. 1 schematically illustrates a motion therapy system according to some possible embodiments.

One or more specific and/or alternative embodiments of the present disclosure will be described below with reference to the drawings, which are to be considered in all aspects as illustrative only and not restrictive in any manner. It shall be apparent to one skilled in the art that these embodiments may be practiced without such specific details. In an effort to provide a concise description of these embodiments, not all features or details of an actual implementation are described at length in the specification. Elements illustrated in the drawings are not necessarily to scale, or in correct proportional relationships, which are not critical. Emphasis instead being placed upon clearly illustrating the principles of the invention such that persons skilled in the art will be able to make and use the motor therapy techniques, once they understand the principles of the subject matter disclosed herein. This invention may be provided in other specific forms and embodiments without departing from the essential characteristics described herein.

The present application discloses motor therapy techniques employing application of error enhancement and/or correction forces over an exercised body portion of a treated individual/patient. The application of these error enhancement/correction forces is based on an error regulating function/profile specifically tailored in accordance with the characteristics of the patient, and its parameters can be continuously and adaptively adjusted in accordance with the performance and/or progress made by the patient in the conducted exercise sessions. One or more initial parameters of the error regulating function/profile can be determined based on patient data indicative of the patient status, impairment, and/or general information associated therewith (e.g., age, sex, weight, height, etc.). Thereafter, one or more parameters of the error regulating function/profile are adjusted based on measurement data obtained from exercise sessions conducted with, or without, application of error regulating forces.

The motor therapy/rehabilitation techniques disclosed herein are useful for, but not restricted to, robot-assisted therapy systems, wherein the exercised body portion of the patient is coupled to one or more robotic arms (generally referred to herein as robotic arm system) configured to apply interfering, or assisting, forces thereover during the exercise sessions. A sensing system is used to measure data/signals indicative of motion patterns/trajectories performed by the exercised body portion, and/or forces thereby applied, during the exercise sessions. The measurement data/signals are used to determine errors/deviations of the performed motion patterns/trajectories with respect to motion patterns/trajectories expected/desired for the exercise being performed by the patient. The determined errors/deviations are sued to adjust one or more parameters of the error regulating function/profile. This way, the error regulating forces applied in each exercise session conducted by the patient are continuously adapted to the patient performance and progress.

Procedures for initially determining the error range and maximal operable force value for the patient can be carried out using preliminary exercise sessions configured to determine adaptive response of the patient (e.g., by computing average error and/or maximally applied forces), and/or based on patient data/medical records. The error range and/or the maximal applicable force can be determined from data associated with a certain segment/portion of the exercise performed and/or a certain time window during the exercise. A desired progression curve for a patient can be produced based on patient's performance and progress. A slope of an error enhancement, and/or error correction, function (e.g., an error regulation function/profile) for the patient, can be determined based on preliminary sessions and/or patient data/medical records, as described hereinbelow in details.

For an overview of several example features, process stages, and principles of the invention, the examples of a robotic-assisted therapy system is schematically illustrated in the figures. This robotic-assisted system is shown as one example implementation that demonstrates a number of features, processes, and principles used to construct and adapt the error regulation motor therapy schemes disclosed herein, which can be also useful for other applications and in different variations. Therefore, this description will proceed with reference to the shown examples, but with the understanding that the invention recited in the claims below can also be implemented in myriad other ways, once the principles are understood from the descriptions, explanations, and drawings herein. All such variations, as well as any other modifications apparent to one of ordinary skill in the art and useful in motor therapy applications may be suitably employed and are intended to fall within the scope of this disclosure.

FIG. 1 schematically illustrates a motion therapy system 10 comprising in some embodiments a control system 13 coupled to a sensing system 11, and to a force applying device to 12 (actuators). The force applying device 12 is configured to apply forces to a body portion (e.g., limb and/or hand and/or fingers) 15 of a treated individual by one or more robotic arms a1, a2, . . . (collectively referred to herein as robotic arm or arms ai, where i>0 is an integer number), mechanically coupled to one or more electric motors m1, m2, . . . (collectively referred to herein as motor or motors mi, where i>0 is an integer number). In this specific and non-limiting example the exercised body portion 15 is secured to one of the robotic arms (a2) by an adjustable loop strap 14, but in other possible embodiments the exercised body portion 15 can be placed in other fastening means coupled to the robotic arms ai, or just used to grasp a free end portion/component of the robotic arm ai.

The sensing system 11 comprises one or more sensor devices (not shown in FIG. 1) configured to measure various parameters indicative of the position, velocity, acceleration, force and/or pressure associated with the exercised body portion 15, and/or the robotic arms ai, during the exercises performed by patients. The one or more sensors of the sensing system 11 can be configured to determine motion patterns/trajectories of the exercised body portion 15 and/or the arms ai, and/or measure forces applied to the arms ai by the exercised body portion e.g., as part of an exercise thereby performed, and/or in response to forces applied thereto by the system. The one or more sensors of the sensing system 11 can be configured to directly measure the response force of the exercised body portion 15, and/or to measure the response force via its effect on one or more parameters or conditions of an operative device (not shown) being operated by the patient (also referred to herein as treated individual or individual) during the training session.

The sensing system 11 can be at least partially integrated in the force applying device 12, to utilize strain gauge sensors, load cells, and/or pressure sensors, for measuring forces applied by the exercised body portion over the robotic arms ai, and/or position/motion sensors (e.g., potentiometers, gyro sensor), velocity meters and/or accelerometers for measuring their positions, velocities and/or accelerations. At least some of the sensing equipment of the sensing system 11 can be configured for remote sensing i.e., not being in direct contact with the exercised body portion and/or the components of the force applying device 12 e.g., utilizing imagers/cameras to generate image data for determining the position, velocity and/or the acceleration data/signals, and/or ammeters/voltmeters to measure electric currents/voltages of the motors mi and determine therefrom forces applied to the arms ai by the exercised body portion 15 during the exercises performed. In possible embodiments the sensing system 11 is at least partially integrated in the control system 13. Optionally, the sensing system 11 is an independent standalone system configured to operate separately from, and in data/signal communication with, the control system 13.

In possible embodiments the sensing system 11 comprises one or more sensor elements directly coupled/attached to the body of the patient for measuring forces thereby applied during the exercises performed by the exercised body portion 15. For example, but without being limiting, one or more electromyograph (EMG), surface EMG, and/or intramuscular EMG, sensor elements can be attached to the body of the patient for generating measurement data/signals indicative of muscular activity/contractions in the patient's body and of the forces applied by patient during the exercises performed by the exercised body portion 15.

The control system 13 is configured and operable to receive and process the measurement data/signals 11*m* generated by the sensing system 11, continuously/periodically determine position, velocity and/or acceleration of the exercised body portion 15 of the treated individual and/or of the robotic arms ai, and/or determine pressures/forces applied by the exercised body portion 15 over the robotic arms ai, and optionally respective time profiles thereof, and based thereon generate control data/signals 13*c* for operating the force applying device 12 accordingly.

In possible embodiments the force applying device 12 is configured and operable to controllably apply forces of predetermined profiles to the body portion 15 during a therapeutic exercise/session thereby performed. The sensing system 11 can be configured and operable to monitor one or more training sessions of the exercised body portion 15 of the treated individual, and selectively generate first measurement data/signals indicative of error-related data, and second measurement data/signals indicative of adaptive response of the treated individual to the force applied to the exercised body portion 15 of the treated individual.

The control system 13 is configured and operable to communicate data/signals with the sensing system 11 and with the force applying device 12, process the first and second measurement data/signals (11*m*) generated by the sensing system 11 to determine therefrom the error-related data and the adaptive response of the treated individual to the exercise thereby performed, and accordingly generate the control data/signals 13*c* for operating the force applying device 12 to adjust the forces thereby applied over the exercised body portion 15. The control system 13 thus comprises in some embodiments one or more processors 13*u* and (volatile and/or non-volatile) memories 13*m* configured to store and execute software instructions for operating the system 10, and store and process the measurement data 11*m* from the sensing system 11. The control system 13 can also comprise a communication interface (I/F) 13*i* configured to communicate data/signals with corresponding communication interfaces (I/F) of the sensing system 11 and/or of the force applying device 12.

A human-machine-interface (HMI) unit 13*h* can be provided to present information associated with treatment sessions being conducted and/or with the treated individual e.g., on a display device (not shown e.g., touchscreen). The HMI 13*h* can be configured to receive input information from a user/practitioner by one or more input devices thereof (not shown e.g., keyboard, pointing device/mouse, touchscreen, or suchlike). The HMI 13*h* can be part of the control system 13, or a separate system electrically coupled (e.g., over data/signals communication wires/lines, or wirelessly) to the control system 13.

The communication between the control system 13 and the sensing system 11, and/or the force applying device 12, can be conducted wirelessly (e.g., using WiFi, Bluetooth, Zigbee), and/or over data/signals communication lines/wires (e.g., a serial/parallel data bus using USB, UART, ETHERNET, or suchlike). It is noted that the communication indicated in FIG. 1 by two sided arrowed lines can be bidirectional, but in possible embodiments it may be unidirectional. For example, and without being limiting, the communication between the sensing system 11 and the control system 13 can be configured for transmission of the measurement data 11*m* to the control system 13, and the communication between the force applying device 12 and the control system 13 can be configured for transmission of the control data/signals from the control system 13 to the force applying device 12.

In some embodiments the control system 13 comprises a force controller 13*f* configured and operable to manage operation of the force applying device 12 according to operational data generated by the control unit 13, corresponding to the measurement data/signals 11*m* generated by the sensing system 11. For example, but without being limiting, the force controller 13*f* can be configured and operable to determine from the operational data adjustments for the forces being applied by the force applying device 12 to the exercised body portion 15, and generate respective control data/signals 13*c* to the force applying device 12 for increasing (or decreasing) the forces thereby applied to the exercised body portion 15 in accordance with a predetermined range of the error regulating profile/function. For example, the force controller 13*f* can be configured and operable to generate control data/signals 13*c* for progressively increasing (or decreasing) the forces applied by the force applying device 12 responsive to the first and/or second measurement data/signals until a determined maximal, or minimal (e.g., zero, no force), applicable force level is reached.

The control system 13 can use an analyzer module 13*a* configured and operable to selectively provide force adjustment data indicative of the maximal applicable force value(s) to be used with the error regulating profile/function, based on individual-related (patient) data record 14*d* associated with the exercise being performed. Additionally, or alternatively, the analyzer module 13*a* can be configured and operable to analyze at least one of the first and second measurement data/signals to determine therefrom data indicative of adjustment to ranges of the error regulating profile/function, and generates based thereon the operational data used by the force controller 13*f* to generate the control data/signals 13*c* in accordance with the error regulating profile/function used. The treatment session can be carried out continuously, or repeatedly, until identifying a predetermined condition associated with the second measurement data indicative of the adaptive response of the treated individual to the forces applied by the force applying device 12.

For example, the analyzer module 13*a* can be configured and operable to determine from the measurement data 11*m* received from the sensing system 11 motion patterns/trajectories performed by the exercised body portion 15, and forces thereby applied during a training session having a defined trajectory of movement (and/or time interval(s), and/or velocities, and/or accelerations, associated therewith). The analyzer module 13*a* can be configured to compare the determined motion patterns/trajectories, and/or forces applied by the patient (and/or optionally the time intervals, and/or velocities, and/or accelerations, associated therewith), to desired motion patterns/trajectories, and/or forces (and/or desired time intervals, and/or desired time interval ranges/patterns, and/or velocity and/or acceleration ranges/patterns), for the performance of the training session, and determine errors/deviations for the motion patterns/trajectories performed by the exercised body portion 15 based thereon. The determined errors/deviations can be then used by the analyzer module 13*a* to adjust parameters of the error regulating function used for the training session performed by the system 10.

The training session can be then repeated using the error regulating function with the newly determined parameters, to determine therefore respective new errors/deviations from the desired motion patterns/trajectories, and/or applied forces, to monitor the patient's performance and progress. This adaptive training session process can be continuously or repeatedly repeated a predetermined number of times, or until the determined errors/deviations determined for the motion patterns/trajectories, and/or applied force, are acceptably small.

The patient data record 14*d* can be stored locally in the memory 13*m* of the control system 13, and/or in a database 14 accessible by the control system 13. The database 14 can be also part of the control system 13, but in possible embodiments it is operated and maintained as a separate (e.g., remote) database system (e.g., database server, cloud data center, or suchlike) accessible via regular data communication links e.g., ETHERNET, Internet, or suchlike. The patient data record 14*d* may comprise initial patient information concerning the treated individual, such as, but not limited to, age, sex, weight, height, and suchlike, and/or information concerning the physical state and/or disabilities of the treated individual, including without limiting, dominance of the treated body portion (e.g., limb, hand), preliminary evaluation of the patient's motoric abilities and/or impairments, and suchlike.

Optionally, but in some embodiments preferably, the patient data comprises force adjustment data indicative of the maximal applicable force to be applied by the system 10 in the treatment sessions of the patient. The force adjustment data can comprise parameters of the error regulating function/profile determined by a practitioner e.g., based on patient diagnosis, and/or based on the initial patient information, and/or on previously conducted training sessions conducted by the system 10. The control system 13 can be configured and operable to record in the patient data record 14*d* adjusted/new force applying profiles, which may comprise adjusted/new force/error regulating parameters determined by the analyzer module 13*a* during the one or more treatment sessions conducted by the system 10, maximal applicable forces to be used for error enhancement and/or correction, and/or data indicative of the progress of the treated individual in each treatment session. The patient data record 14*d* may comprise a set of different error regulating functions/profiles tailored for the specific patient and to be used in respective different exercises conducted by the patient with the system 10.

The analyzer module 13*a* can be configured and operable to access the patient data record 14*d* and retrieve therefrom the parameters of the error regulating function/profile (e.g., maximal applicable force value) to be used in a specific exercise to be performed by the patient in a treatment session. The analyzer module 13*a* can be configured and operable to receive and analyze input data 13*d* received from a practitioner (e.g., via the HMI unit 13*h*) and/or from the data record 14*d*. The input data 13*d* can comprise the individual-related data associated with a specific exercise to be performed by the patient using the system 10. The analyzer module 13*a* can be configured to determine from the received input data 13*d* force adjustment data indicative of the maximal applicable force value to be used for the error regulating profile/function.

The sensing system 11, and/or the analyzer module 13*a*, can be configured to process measurement data/signals from the sensing system 11 (e.g., motion sensor) indicative of movements performed by the exercised body portion 15, and/or of forces, and/or velocitied, and/or accelerations, thereby applied, and determine based thereon motion and/or force application patterns characterizing the performance of the patient in one or more training sessions. The motion and/or force application patterns can be determined by monitoring motion performed, and/or forces applied, by the exercised body portion 15, and/or using one or more parameters or conditions of an operative device operated by the patient during the training session. The determined motion and/or force application patterns can be used by the sensing system 11, and/or the analyzer module 13*a*, to identify errors/deviations from desired motion and/or force application patterns. These errors/deviations can be measured over time and used to generate the first measurement data comprising the error-related data.

The motion therapy system 10 can be implemented by embodiments, and/or equipment components, disclosed in international patent publication No. WO 2004/096501 of the same assignee hereof, the disclosure of which is incorporated herein by reference.

Figure 2:
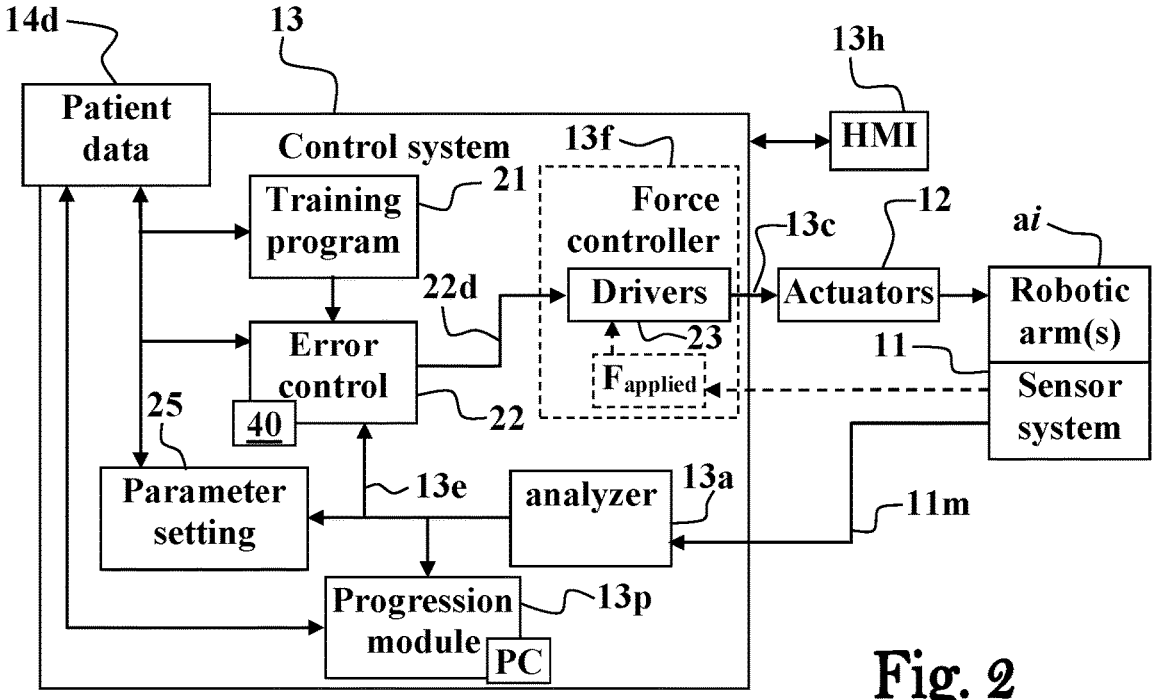
FIG. 2 schematically illustrates components of control schemes according to some possible embodiments.

FIG. 2 shows a block diagram schematically illustrating a control scheme usable by the control system 13 according to some possible embodiments. In this non-limiting example, the control system is configured to receive, or construct, a training program 21 comprising one or more exercises to be performed by the exercised body potion (15). Each exercise of the training program 21 can include a desired/expected motion and/or force application pattern/trajectory data associated with the respective exercise and indicative of expected directions of the desired motion pattern. The training program 21 can be constructed by the control system based on the patient data record 14*d*, or by the practitioner operating the system 10 e.g., via the HMI 13*h*. Alternatively, or additionally, the training program 21 can be stored in the patient data record 14*d* and updated from time to time by the control system, and/or by a parameter setting module of the control system 13.

The control system 13 comprises in some embodiments an error control module 22 configured and operable to determine operational data/signals 22*d* indicative of forces to be applied over the exercised body portion (15). The error control module 22 can be configured and operable to determine the operational data/signals 22*d* based on information from the patient data record 14*d* e.g., the error regulating function/profile 40 and the error-related data 13*e* indicative of instantaneous deviations of the motion of the exercised body portion (15) from the desired trajectory, and/or a desired velocity and/or acceleration pattern. For example, the error control module 22 can be configured and operable to determine the magnitude and direction of the forces to be applied by the system over the exercised body portion (15), with respect to the expected trajectory/motion data of the training program 21, and determine based thereon the operational data/signals 22*d* indicative of the error regulating forces to be applied to the exercised body portion (15) by the robotic arms ai during the exercise. The operational data/signals 22*d* from the error control module 22 is received in the force controller 13*f*, wherein it is used by the drivers control module 23 to generate the control data/signals 13*c* for activating the force applying device 12 accordingly. The the force applying device 12 can accordingly actuate the robotic arms ai to apply respective error regulating forces to the exercised body portion 15 along the desired motion pattern/trajectory and within the desired time profile.

For example, the error control module 22 can be configured and operable to use the error regulating function/profile 40 to determine based on the error-related data 13*e* the magnitude of the error regulating forces to be applied over the exercised body portion (15), and whether these error regulating forces should be error enhancing or correction forces. If it is determined that error enhancing forces are to be applied, then the operational data/signals 22*d* generated by the error control module 22 are configured for applying the error regulating forces having the determined magnitude directed radially away from the desired trajectory of the training program 21. On the other hand, if it is determined that error correction forces are to be applied, then the operational data/signals 22*d* generated by the error control module 22 are configured for applying the error regulating forces having the determined magnitude directed radially towards the desired trajectory of the training program 21.

As the exercise is being performed by the treated individual, the sensor system 11 generates the measurement data/signals 11*m* indicative of the motion performed by the exercised body portion 15 during the exercise, which is inputted to the control system 13. The measurement data 11*m* is processed by the analyzer module 13*a* to determine the actual motion performed by, and/or position of, the exercised body portion 15, and/or forces, and/or velocities, and/or accelerations, applied by the treated individual during the exercise, and the error data 13*e* indicative of deviations of the actual motion performed from the desired motion pattern/trajectory and of the direction and magnitude of each error/deviation, and/or of forces, and/or velocities, and/or accelerations, applied by the exercised body portion during the exercise. The error data 13*e* determined by the analyzer module 13*a* can be used by the parameter setting module 25 to adjust one or more parameters (e.g., maximal applicable force and/or slope(s) of error enhancement or correction function) of the error regulating function/profile 40 used by the error regulating module 22.

The parameters adjusted by the parameter setting module 25 can be recorded in the patient data record 14*d* for adjusting the error regulating function/profile 40 to be used in the next exercise session of the system 10 in accordance with the performance and progress of the treated individual. Optionally, the parameter setting module 25, and/or the error control module 22, is an integral part of the analyser module 13*a*, or of the force controller 13*f*.

In some embodiments the force controller 13*f* is configured to receive measurement data/signals directly from the sensor system 11, as shown in FIG. 2 by dotted lines, for continuously/periodically adjusting the forces applied by the robotic arm(s) ai over the treated body portion (15). For example, the force controller 13*f* can be configured to continuously/periodically receive data/signals from the sensor system 11 indicative of the force applied ($F_{applied}$) by the treated body portion (15) of the treated individual over the robotic arm(s) ai, and accordingly adjust the control data/signals 13*c* generated by the drivers control module 2, thereby driving the force applying device 12 to guarantee that the desired forces are applied by the system, according to the operational data/signals 22*d* from the error control module 22. This way, an internal closed feedback loop is formed to guarantee in real-time that the desired error regulating forces are being applied by the system over the treated body portion.

Figure 8:
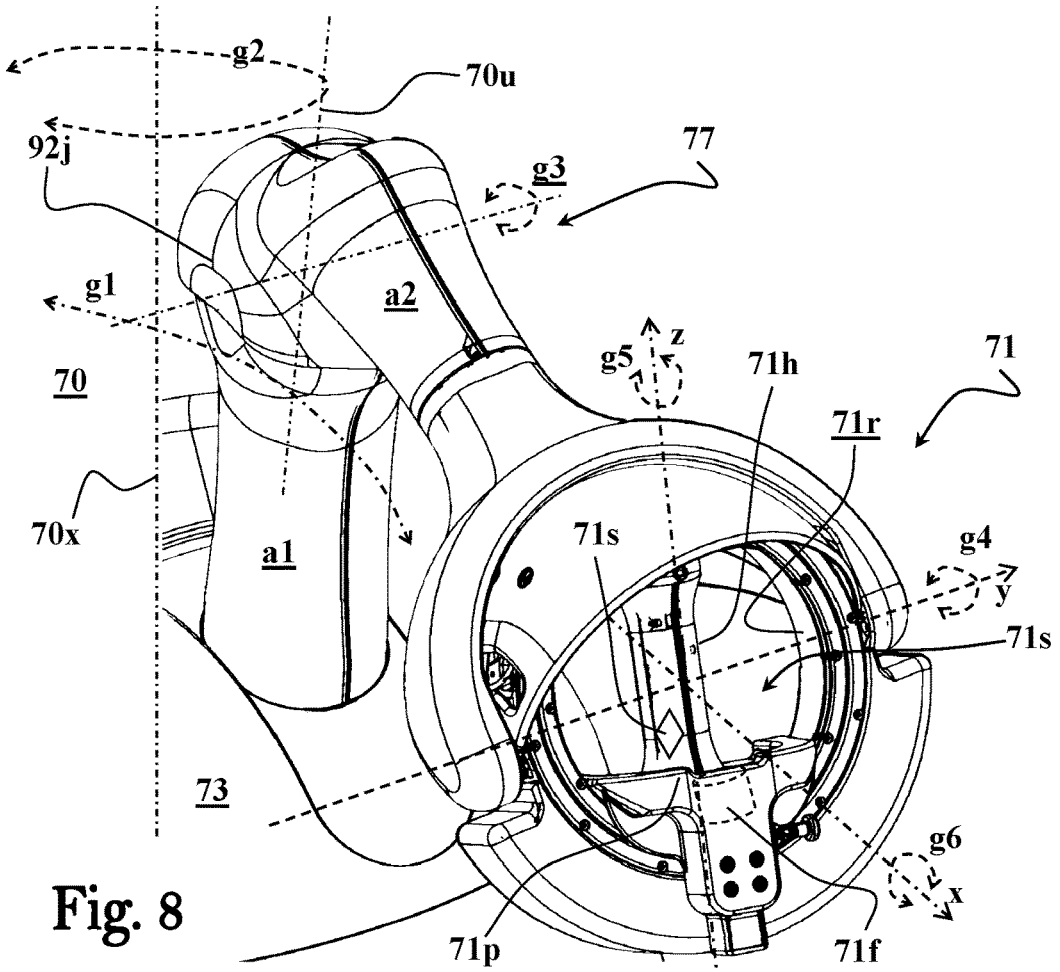
FIG. 8 shows a close view of the gimbal-handpiece manipulator according to some possible embodiments.
Figure 9:
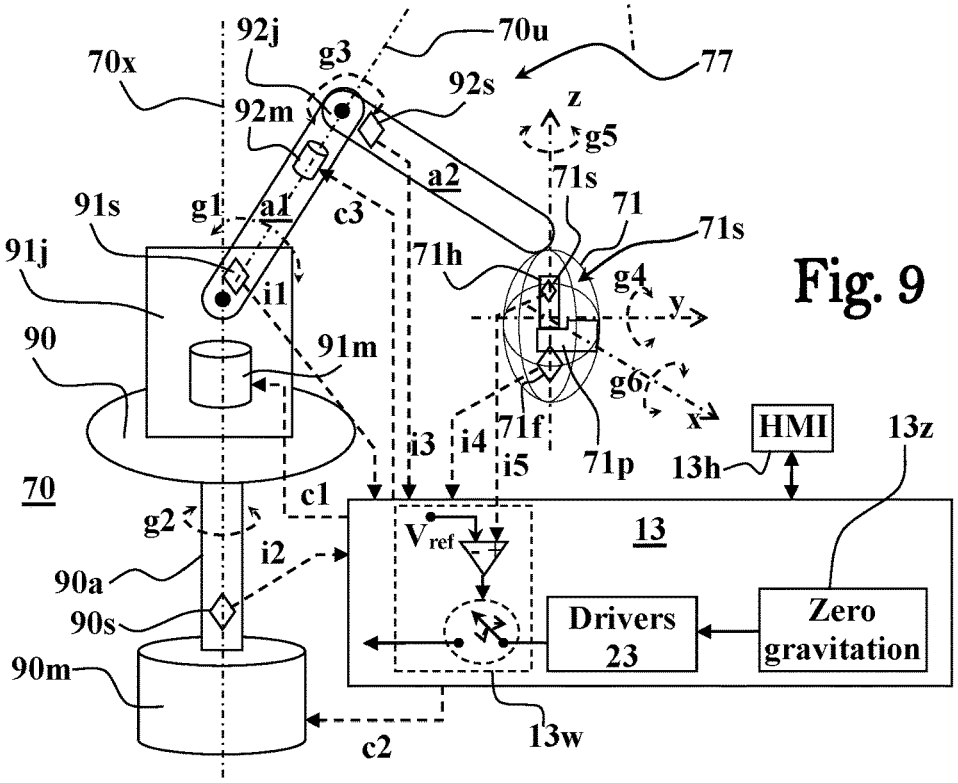
FIG. 9 schematically illustrates components of the motion therapy system, robotic arm system, and gimbal-handpiece manipulator, according to some possible embodiments.

For example, in some embodiments the force controller 13*f* is configured to implement a force-control scheme in which the data/signals 13*c* generated by the drivers control module 23 operate the force applying device 12 to apply forces for moving the robotic arms ai in directions of the forces $F_{applied}$ applied by the treated individual over the robotic arms ai, as measured by the sensor system 11 e.g., using the force/load sensor 71*f* shown in FIGS. 8 and 9. Accordingly, in the force-control scheme the robotic arms ai is continuously moved by the system in the directions of the forces ($F_{applied}$) the treated subject applies thereover. As seen in FIG. 2, the movements of the robotic arms ai affected by force-control scheme can be adjusted to incorporate the error regulating forces according to the operational data/signals 22*d* generated by the error control module 22 according to the deviations/errors in the trajectory performed by the treated individual during the exercise session.

Optionally, but in some embodiments preferably, the analysed data/signals 13*e* from the analyzer module 13*a* is further used in a progression module 13*p* of the control system 13 to generate progression data indicative of the progress the treated individual made over time and/or one or more treatment sessions, and/or a progression curve PC indicative of desired progress rate(s) expected from the treated individual. The progression curve PC can be generated based on initial (or continuous) progress measures determined by the progression module 13*p* based on the analysed data/signals 13*e* from the analyzer module 13*a*, and/or predefined (e.g., normalized) progression curves specifically fitted and adjusted to the treated individual e.g., based on the patient data record 14*d*. The progression module 13*p* can be further configured to monitor the progress made by the treated individual based on the determined progression curve PC and/or the analysed data/signals 13*e* from the analyzer module 13*a*, and record data indicative thereof in the patient data record 14*d*.

Figure 3:
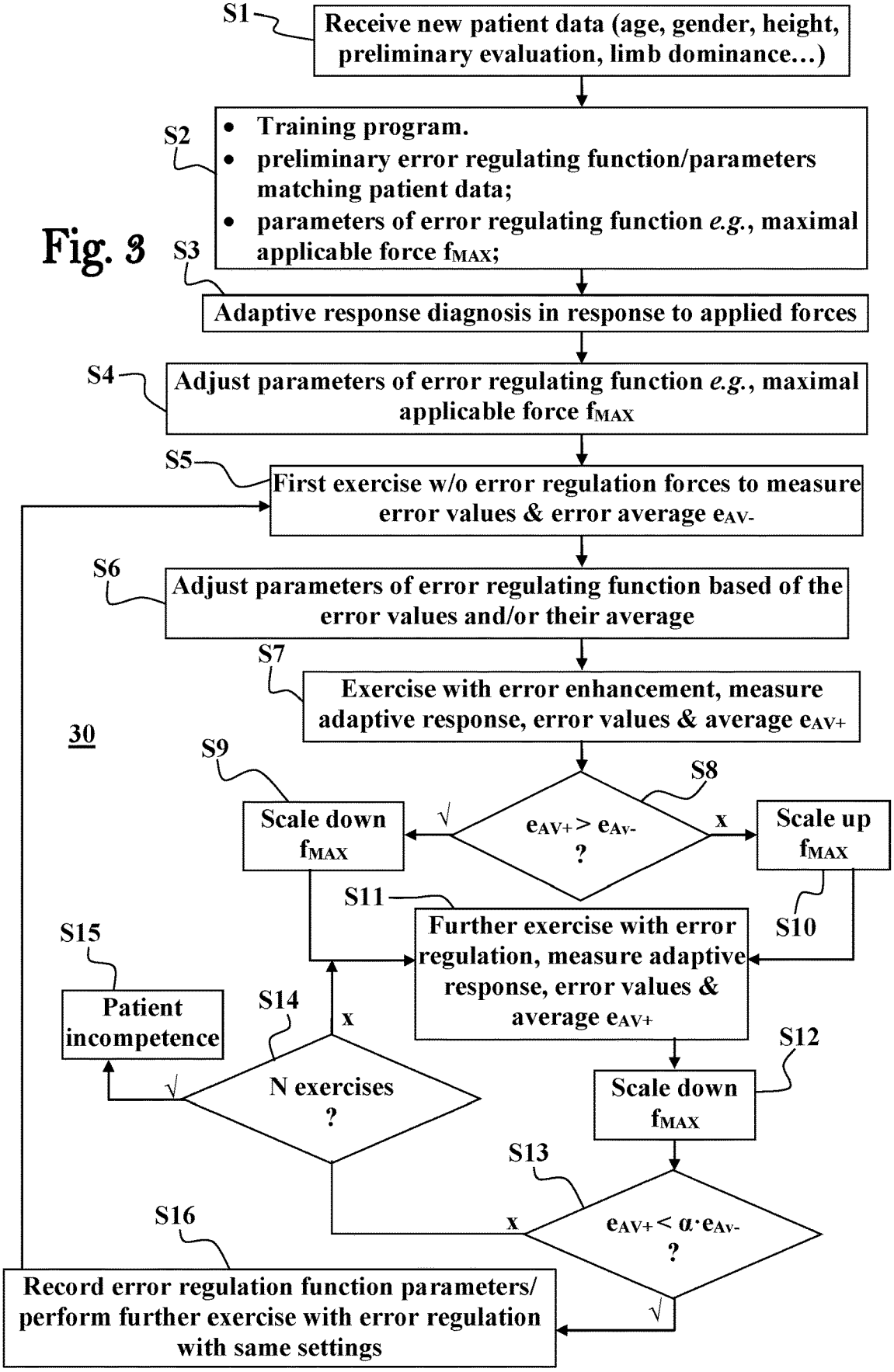
FIG. 3 is a flowchart schematically illustrating a treatment process according to some possible embodiments.

FIG. 3 shows a flowchart of a treatment scheme 30 usable with the motion therapy system 10. The process 30 starts in step S1, wherein new patient data is retrieved and processed by the system (10) e.g., from the memory (13*m*) or from the patient data record (14*d*) received from the database (14). In step S2 the system (10) determines based on the retrieved patient data (e.g., patient's ability to exert force by the exercised body portion, age, sex, dominance of the body portion, etc.) a training program, and/or a preliminary error regulating function/profile (40) and/or parameters, and/or an initial (safety) maximal applicable force $f_{MAX}$ for the error regulating function/profile (40) to be used by the motor therapy system (10) in the exercise session(s) to be performed.

The system (10) determines in step S3 adaptive response diagnosis for the patient in response to applied forces, by carrying out a diagnostic exercise session. In this step the patient is instructed to move the robotic arms ai and perform predefined motion patterns/trajectories while the system (10) operates the force applying device (12) to apply different (interfering or assisting) forces by the arms ai. The measurement data (11*m*) generated by the sensing system (11) in response to the movements of the exercised body portions (15) is then processed and analyzed to determine the patient's adaptive response based on error values, that may vary in accordance with the application of varying forces by the system (10). The error values can be determined by comparing the loads/pressures measured by the sensing system (11) during the diagnosis exercise session to predefined values, or with respect to history of force application by the system (10), or with respect to force applied by the system in previous training session(s).

Figure 4:
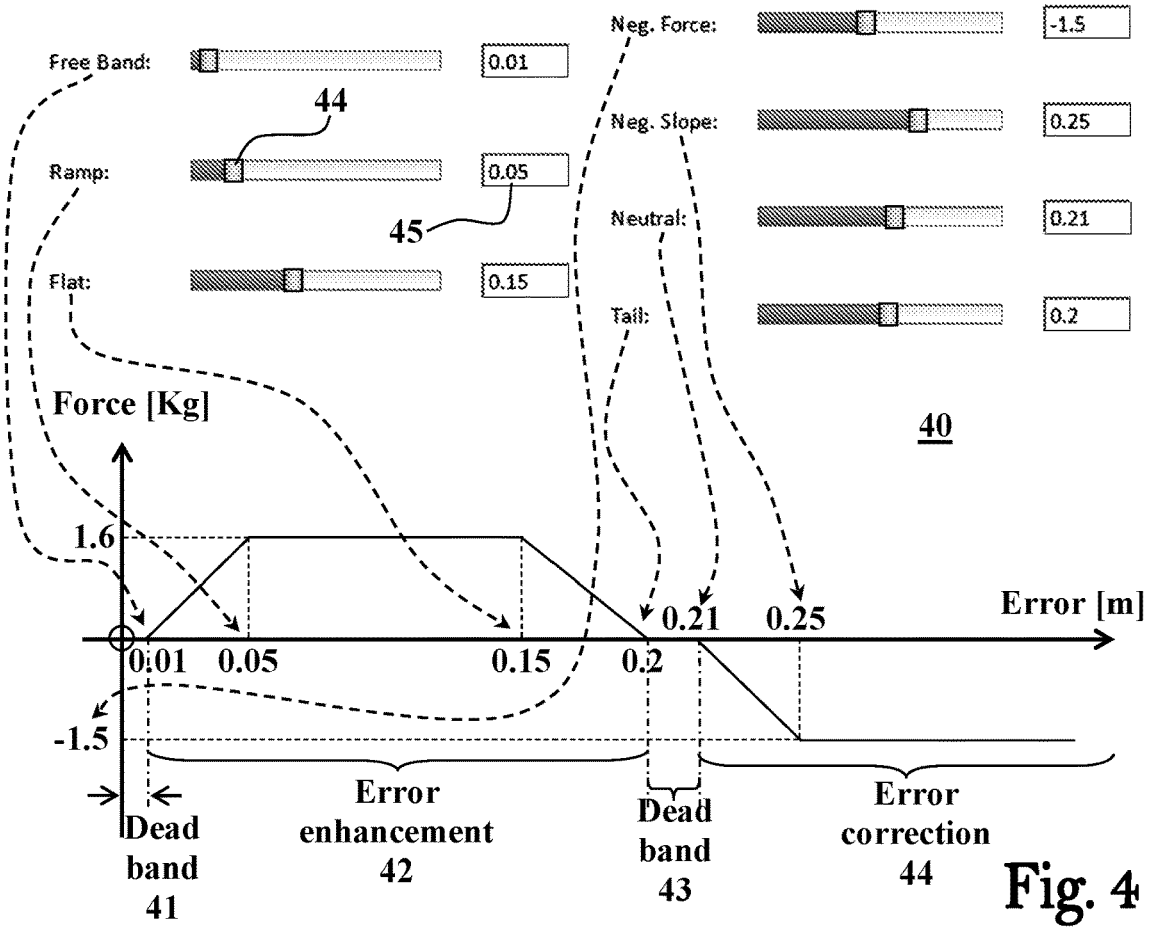
FIG. 4 schematically illustrates an error regulating function and a human-machine-interface (HMI) usable for setting its parameters according to possible embodiments.

The adaptive response diagnosis determined in step S3 is used in step S4 to adjust one or more parameters of the error regulating function/profile (40), such as, but not limited to the initial maximal applicable force $f_{MAX}$ determined for the error regulating function/profile in step S2, and/or the set point values shown in FIG. 4 (Free Band, and/or Ramp, and/or Flat, and/or Neg-Force, and/or Neg-Slope, and/or Neutral, and/or Tail). In exemplary embodiments one or more average error values are determined during the diagnostic exercise session of step S3 based on the data/signals measured responsive to the forces applied by force applying device (12), and/or respective one or more local maximal force values applied by the treated individual during the diagnostic exercise session. The determined average error values and/or their respective local maximal force values are indicative of the ability of the treated subject to adapt the motion exercise thereby performed to unexpected interfering or assisting forces applied by the arms ai. Parameters of the error regulating function/profile (40) can be determined in step S4 based on at least one of the determined average values and its respective determined local maximal applied force. For example, but without being limited, one or more of the determined average errors and the respective one or more determined local maximal force values can be used in step S4 to determine slope(s) of error enhancement (42) and/or correction (44) function of the error regulating function/profile (40).

Optionally, but in some embodiments preferably, the parameters of the error regulating function/profile (40) determined in step S4 includes an average error value and an optimal adaptive force response of the individual to the exercise thereby performed. Step S4 can further include determine based on the determined average error value and an optimal adaptive force response at least one slope of the error enhancement function (42), and/or of the error correction function (44), of the error regulating function/profile (40). The error regulating function/profile (40) can be accordingly defined by an error enhancement and/or correction slope determined based on an average error value and an optimal adaptive force response of the individual to the exercise(s) thereby performed, and confined to maximal forces that are based on the maximal applicable force ($f_{MAX}$) determined for the error regulating function/profile (40).

In step S5 one or more training sessions are performed by the system (10) to exercise the body portion (15) without application of error regulating forces. In this step the treated individual is instructed by the system (e.g., via the HMI 13*h*) and/or by the practitioner to perform certain movements by the body portion (15) while coupled to the arms ai, without applying forces by the force applying device (12) of the system (10), while measuring by the sensing system (11) the forces applied by the individual, and the motion pattern/trajectory, and/or velocities and/or accelerations, thereby performed. The system then computes error values by comparing the performed motion pattern/trajectory, and/or applied forces, and/or velocities and/or accelerations, as determined from the measurement data (11*m*) to the motion pattern/trajectory, and/or force application, and/or velocities and/or accelerations patterns, expected for the certain movements the treated individual is instructed to perform, and an average error $e_{AV-}$ is then accordingly determined for the exercised body portion (15) without the application of error regulating forces by the system (10). Optionally, but in some embodiments preferably, the average error $e_{AV-}$ determined for the patient exercising without error regulating forces is determined from distances measured in three-dimensional space of the exercised body portion from desired trajectory/locations associated with the exercise performed by the patient.

The error values and/or average error $e_{AV-}$ computed in step S5 are used in step S6 to adjust ranges of error regulating function/profile (40) to be used in step S7, in which one or more training sessions are performed with the application of error regulating forces. Step 6 can be configured to adjust any of the parameters of the error regulating function/profile (40) used by the system, such as the maximal applicable force $f_{MAX}$, and/or slope(s) of error enhancement and/or correction function of the error regulating function/profile (40), and/or any of the set point values shown in FIG. 4 e.g., Free Band, and/or Ramp, and/or Flat, and/or Neg-Force, and/or Neg-Slope, and/or Neutral, and/or Tail. Optionally, but in some embodiments preferably, the values determined in step S5 are used to compute at least one slope of the error enhancement function (42), and/or of the error correction fuction (44), of the error regulating function/profile (40) based on the error values and/or average error $e_{AV-}$, and a previously determined optimal adaptive force response or an optimal adaptive force response newly determined based on measurement data collected form one or more of the exercises performed so far by the treated individual.

In some embodiments steps S3 and S4 are not used in the process 30. In such embodiments the initial error regulating function (40), and its initially parameters, as determined in step S2, are adjusted in steps S5 and S6.

After completing the one or more training sessions of step S7, the system determines based on the measurement data (11*m*) obtained for the performed training sessions errors/deviations occurred within the performed training sessions with respect to a desired/expected motion pattern/trajectory, and/or force application profiles. The system can determine based on the errors/deviations at least one of a measure for the patient's adaptive response and an average error $e_{AV+}$ for the exercised body portion (15) with the application of error regulating forces by the system (10). The determination of the errors/deviations can be at least partially based on comparison of the loads and/or time profiles, and/or velocities and/or accelerations, measured by the sensing system (11) during the training session to predetermine load values and/or time profiles expected for the training session performed by the patient, and/or with respect to load values measured by the sensing system in previous training sessions. Optionally, but in some embodiments preferably, the errors/deviations used to determine the average error $e_{AV+}$ are determined from distances measured in three-dimensional space of the exercised body portion from the desired trajectory of the training exercise performed by the treated individual.

Step S8 checks if the average error $e_{AV+}$ determined for exercising the body portion (15) with the application of error regulating forces in step S7 is greater than the average error $e_{AV-}$ determined for exercising the body portion (15) without the application of error regulating forces. The maximal applicable force $f_{MAX}$ obtained for the error regulating function/profile (40) in step S6 (or the $f_{MAX}$ determined in S2, if steps S3 and S4 are skipped) is then adjusted in accordance with the test of step S8. Particularly, if it is determined in step S8 that the average error $e_{AV+}$ obtained with the application of error regulating forces is greater than the average error $e_{AV-}$ obtained without the application of error regulating forces, then in step S9 the maximal applicable force $f_{MAX}$ is scaled down by a predefined scaling factor. Otherwise, if it is determined in step S8 that the average error $e_{AV+}$ obtained with the application of error regulating forces is smaller than the average error $e_{AV-}$ obtained without the application of error regulating forces, then in step S10 the maximal applicable force $f_{MAX}$ is scaled up by the predefined scaling factor.

For example, the scaling down factor used in step S9 can generally be in a range of 0.5 to 0.9, and the scaling up factor used in step S10 can generally be in a range of 1.1 to 1.5. Alternatively, the scaling factors may be determined, or adapted, in accordance with the individual-related (patient) data record 14*d*. Though the same scaling factor can be used for the down-scaling of step S9, and for the up-scaling of step S10, in possible embodiments a specific down-scaling factor may be set for step S9, and a specific different up-scaling factor may be set for step S10.

Optionally, but in some embodiments preferably, the scaling factor used in steps S9 and/or S10 is determined by the system in accordance with the determined average error $e_{AV+}$ obtained with the application of error regulating forces, and/or a previously determined average error $e_{AV+}$ obtained with the application of error regulating forces, and/or the average error $e_{AV-}$ obtained without the application of error regulating forces. For example, the scaling factor can be determined based on a ratio between a current average error $e_{AV+}^{(j)}$ and a previous $e_{AV+}^{(j-1)}$ average error (where j>1 is an integer number) obtained with the application of error regulating forces, or based on a ratio between a current average error $e_{AV+}$ and the average error $e_{AV-}$ obtained without the application of error regulating forces.

After the maximal applicable force $f_{MAX}$ determined for the error regulating function/profile (40) is scaled down in step S9, or scaled up in step S10, a set of further training sessions are performed in steps S11 to S14 with application of error regulating forces. In these further training sessions the system determines for each training session performed in step S11 respective errors/deviations from expected performance (e.g., based on distances in three-dimensional space of the exercised body portion from the desired trajectory), and corresponding new adaptive response measure, and/or a new average error $e_{AV+}$ for training sessions carried out with the application of error regulating forces determined. After each further training session of step S11 the maximal applicable force $f_{MAX}$ determined for the error regulating function/profile (40) is scaled down in step S12 by the same scaling factor used in step S9 and/or S10, or by a different scaling factor specially determined for the repetitive set of training sessions, to progressively reduce the interfering (and/or assisting) forces applied by the system (10) during the exercises.

Step S13 can be used to check if an acceptable progress level been achieved by the training session of step S11. For example, but without being limiting, an indication that an acceptable progress level been achieved can be that the new average error $e_{AV+}$ determined for training sessions carried out in step S11 with the application of error regulating forces is smaller than some predefined percentage ($\alpha$) of the average error $e_{AV-}$ determined for the training sessions without the application of error regulating forces. The predefined percentage ($\alpha$) can generally be a progress level scaling factor in the range of 0.15 to 0.45, or optionally in the range of 0.2 to 0.4, or about 0.3. Alternatively, or additionally, the progress level is determined in step S13 based on the progress curve (PC, generated by the progression module 13*p*).

If it is determined in step S13 the progress level achieved by patient in the training session of step S11 is not acceptable e.g., that the new average error $e_{AV+}$ determined for the training sessions of step S11 with the application of error regulating forces is smaller than the predefined percentage of the average error $\alpha \cdot e_{AV-}$ determined for the training sessions without the application of error regulating forces, then step S14 checks if the number of repetitions of the training sessions of step S11 exceeded some predefined maximal number (N e.g., 4 to 7) of such repeatedly performed training sessions. If it is determined in step S14 that the number of repetitions of the training sessions of step S11 exceeded the predefined maximal number (N), patient incompetence to the treatment by the system is determined in step S15, due to the patient's failure to improve performance i.e., failure to achieve acceptable progress level, throughout the predefined maximal number (N) of repeatedly performed training sessions S11 with progressively reduced interfering (and/or correcting) forces.

Otherwise, if it is determined in step S14 that the number of repetitions of the training sessions of step S11 did not exceed the predefined maximal number (N), then the control is passed back to step S11 for conducting further training sessions utilizing the maximal applicable force $f_{MAX}$ scaled down in step S12, and for determining respective new errors/deviations from the expected performance, and/or corresponding new adaptive response measure, and a new average error $e_{AV+}$ for training sessions of step S11 with the application of error regulating forces.

If it is determined in step S13 that the progress level achieved by the treated individual in the training session of step S11 is acceptable e.g., the new average error $e_{AV+}$ determined for the training sessions of step S11 with the application of error regulating forces is smaller than the predefined percentage ($\alpha$) of the average error $e_{AV-}$ determined for the training sessions without the application of error regulating forces, then in step S16 the parameters of the error regulating function (40) are recorded (e.g., in the patient's data record 14*d*) for further training sessions to be conducted with application of error regulating forces utilizing the same parameters to memorise by the patient the progress achieved in the process 30. Steps S5 to S16 can be repeated if required, at any suitable time instance e.g., after few minutes, hours, days or weeks, by starting the process in step S5 utilizing the error regulating parameters obtained for the patient in the previous training session(s).

In possible embodiments the average error $e_{AV+}$ or $e_{AV-}$ determined for the patient exercising with/without the error regulating forces is determined from measurements of forces applied by the exercised body portion during the exercise session performed. For example, the forces applied by the exercised body portion can be measured utilizing load cells and/or pressure sensors e.g., using strain gauges, and/or measurements of electric currents of the one or more electric motors (m1, m2, . . . ), and/or directly from the body of the treated individual by one or more electromyograph (EMG), surface EMG, and/or intramuscular EMG, sensor elements. In such possible embodiments the decisions made in step S8 and/or S13 can be made based on comparison of the average error $e_{AV+}$ determined for the patient exercising with the error regulating forces to the maximal applicable force ($f_{MAX}$), or to a portion thereof i.e., instead of the average error $e_{AV-}$ determined for the patient exercising without the error regulating forces.

In possible embodiments the average errors and/or the local maximal forces applied by the treated individual are determined based on the measurement data/signals from the sensing system 11 obtained for specific time intervals, and/or specific sections, of the exercise(s) the treated subject performs with the motion therapy system 10.

FIG. 4 demonstrates an error regulating function/profile 40 usable in possible embodiments of the motion therapy system 10, and human-machine-interface (HMI) controls usable for setting its parameters. The error regulating function 40 can start with a dead band error portion 41 defining a range of small error values (Free Band e.g., between error values of 0 and 0.01) for which the system (10) does not apply forces over the exercised body portion (15). Whenever the errors determined from the measurement data (11*m*) are greater than the error range defined by the dead band error portion 41, and smaller than errors defined by a transition dead band error portion 43 of the error regulating function 40, an error enhancement portion 42 of the error regulating function 40 can be used to determine error augmenting/enhancing (i.e., interfering) forces to be applied by the system (10) during the training session(s). After the transition dead band error portion 43 an error correction portion 44 of the error regulating function 40 can be used to determine error correction forces to be applied by the system (10) during the training session(s).

The error enhancement portion 42 comprises a transition segment (e.g., between error values of 0.01 and 0.05) in which the error regulating forces applied by the system (10) are progressively increased in accordance with increased error values. The error transition segment is followed by a steady force application segment (e.g., between error values of 0.05 to 0.15) in which a constant error augmenting force (e.g., $f_{MAX}$) is applied by the system (10), which is followed by another transition segment (e.g., between error values of 0.15 to 0.2) in which the error augmenting forces applied by the system (10) are progressively decreased in accordance with increased error values.

Accordingly, the application of error augmenting forces by the system (10) can be commenced in the error regulating function 40 utilizing a positive (slope) ramp function for the transition segment defined between the dead band portion 41 and a defined Ramp end error value (e.g., 0.05). In this error range the error enhancement forces applied by the system are monotonically increased with respect to increase in the determined error values, and vice versa, starting from zero force (0 [Kg] i.e., no force is applied), and concluding with the application of the constant error augmenting force (e.g., 1.6 [Kg], $f_{MAX}$) for error values greater than the Ramp end error value. For error values greater than the defined Ramp end error value and smaller than a defined Flat end error value (0.15), the error regulating function 40 produces the constant error enhancement force (e.g., 1.6 [Kg], $f_{MAX}$). For the other transition segment, defined between error values greater than the defined Flat end error value and smaller than a defined Tail error value (0.2), a negative (slope) ramp function can be used by the error regulating function 40 for monotonically decreasing the error enhancing forces from the constant error augmenting force (e.g., 1.6 [Kg]) to a zero error augmenting force (0 [Kg]) with respect to decrease in the determined error values, and vice versa.

The error enhancement portion 42 of the error regulating function 40 is followed by the transition dead band error portion 43, defined between the defined Tail error value (e.g., 0.2) and a defined Neutral error value (e.g., 0.21), and in which the system 10 does not apply error regulating forces (0 [Kg]).

The error correction potion 44 of the error regulating function 40 can start in a transition segment utilizing another negative (slope) ramp function defined for error values greater than the defined Neutral error value (e.g., 0.21) and smaller than a defined negative slope end error value, Neg. Slope (e.g., 0.25), in which absolute values of the error corrective forces applied are progressively increasing with respect to increase in the determined error values, and vice versa, in a direction opposite to the error enhancing forces applied in the error enhancement portion 42 i.e., the error corrective forces applied by the system are actually monotonically decreasing from zero force (0 [Kg]) towards application of a defined constant (negative) error corrective force, Neg. Force (e.g., −1.5 [Kg]). In this non-limiting example, the error regulating function 40 produces the same constant error corrective force for error values greater than the defined negative slope end error value, Neg. Slope.

As exemplified in FIG. 4, the parameters of the error regulating function 40 (i.e., the Free Band range, Ramp end error value, Flat end error segment, Tail error value, Neutral error value, Neutral error value, Neg. Slope error value, and Neg. Force assistive force) can be determined by the user/practitioner utilizing input text box 45 and/or slider 44 controls provided by the HMI (13*h*). Optionally, but in some embodiments preferably, one or more of these parameters of the error regulating function 40 are determined by the control system (13) based on the information obtained from the patient's data record 14*d*, and/or the average error values ($e_{AV-}$ or $e_{AV+}$) determined by the system during the treatment scheme 30 of FIG. 3.

Figure 5:
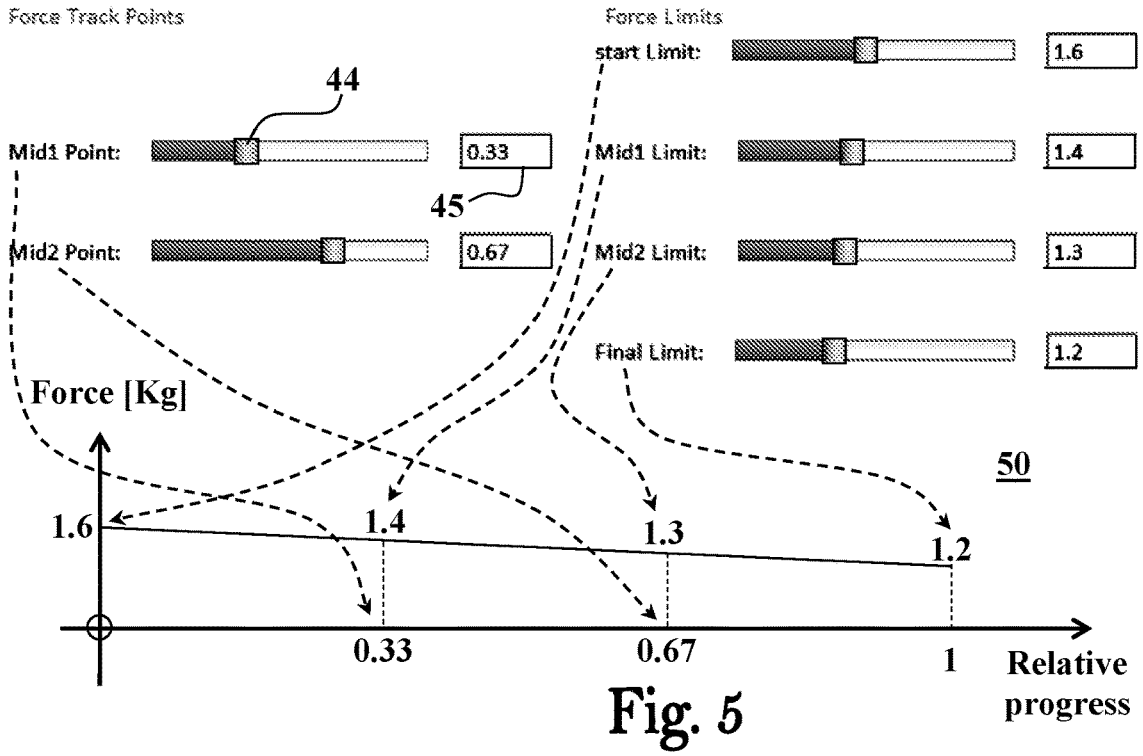
FIG. 5 schematically illustrates adaptive control of the error regulating function with respect to motion progress according to some possible embodiments, and HMI usable for setting its parameters.

FIG. 5 exemplifies a control function 50 usable to adapt the forces of the error regulating function/profile (40) in accordance with motion progress, and HMI controls usable for setting its parameters. The control function 50 is configured to progressively attenuate the error regulating forces of the error regulating function/profile (40) used by the system (10) during a training session, in accordance with progress of motions performed by the exercised body portion (15) e.g., reaching body movements. The use of such control functions 50 may be required due to the increasing efforts the treated individual may experience along certain movements which distally extend away from the body of the treated individual. For example, if a 1.6 [Kg] maximal applicable force $f_{MAX}$ is determined for use with a certain error regulating function/profile, for certain exercises the control function 50 can be used to reduce the applied error enhancement force to 1.4 [Kg] for a relative progress of 0.33, further reduce the applied error enhancement force to 1.3 [Kg] for a relative progress of 0.67 (corresponding to exercising further away from the body movement progress), and further reduce the applied error enhancement force to 1.2 [Kg] at the end of the movement i.e., relative progress of 1.

The control system (13) can be configured and operable to define any suitable monotonically reducing function for the control function 50. For example, the HMI controls (e.g., text boxes 45 and/or sliders 44) can be used to define desired regulating forces to be applied at various different points along the progress axis, and the control system (13) can be configured to determine a respective control function 50 based on the defined forces and progress points e.g., by interpolation or function fitting. In the non-limiting example of FIG. 5 the HMI controls are used to define a control function 50 for a starting error enhancing force defined by the start Limit parameter (e.g., 1.6 [Kg], $f_{MAX}$) i.e., applied at zero (0) relative motion progress, a first intermediate error enhancing force Mid1 Limit (e.g., 1.4 [Kg]) for relative motion progress Mid1 Point (e.g., 0.33), a second intermediate error enhancing force Mid2 Limit (e.g., 1.4 [Kg]) for relative motion progress Mid2 Point (e.g., 0.33), and a final error enhancing force Final Limit (e.g., 1.2 [Kg]) for the end of the exercised movement (for which the relative motion progress is 1).

Figure 6:
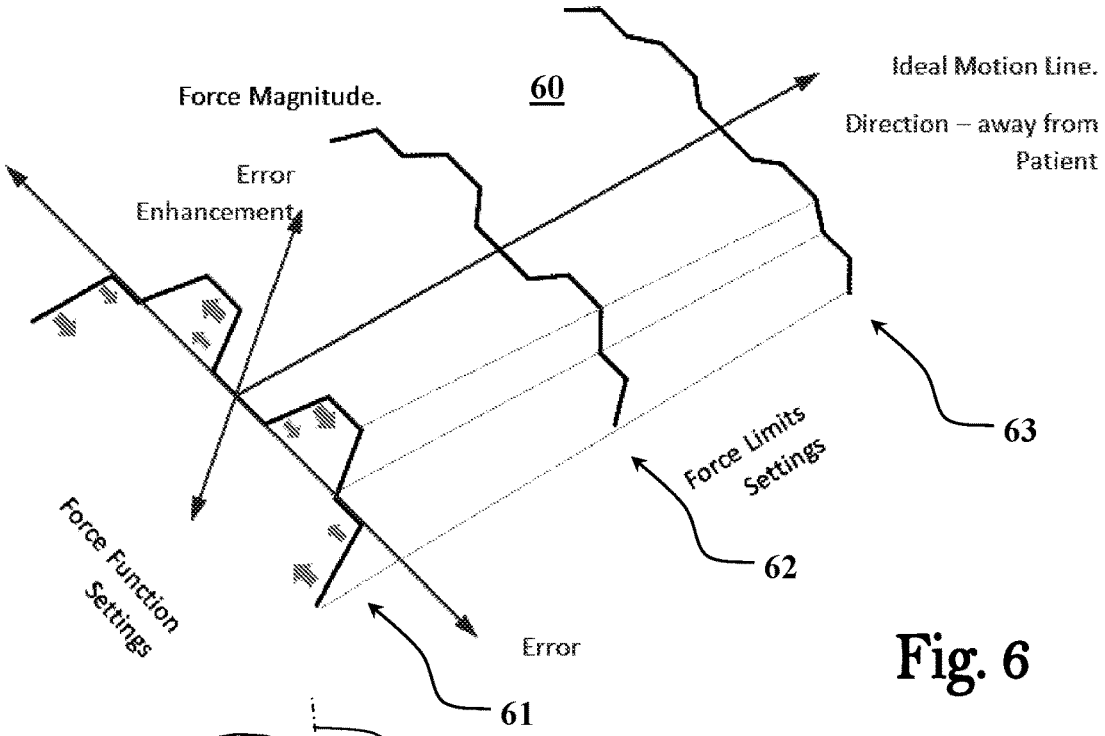
FIG. 6 demonstrates application of the adaptive control exemplified in FIG. 5 to a possible error regulating function/profile.

A control function, such as the control function 50 of FIG. 5, can be similarly used to adapt the error correction portion (44) of the error regulating function/profile, in accordance with motion progress, as exemplified in FIG. 6.

FIG. 6 graphically demonstrates a force control scheme 60 e.g., utilizing a control function (50) to adjust the error regulating forces 61 applied by the system (10). As seen, the magnitudes of the error regulating forces 61 applied by the system (10) are progressively attenuated by the control function as the exercised motion progress to movements further away (distal) from the body of the treated individual, at points 62, 63, . . . .

Figure 7:
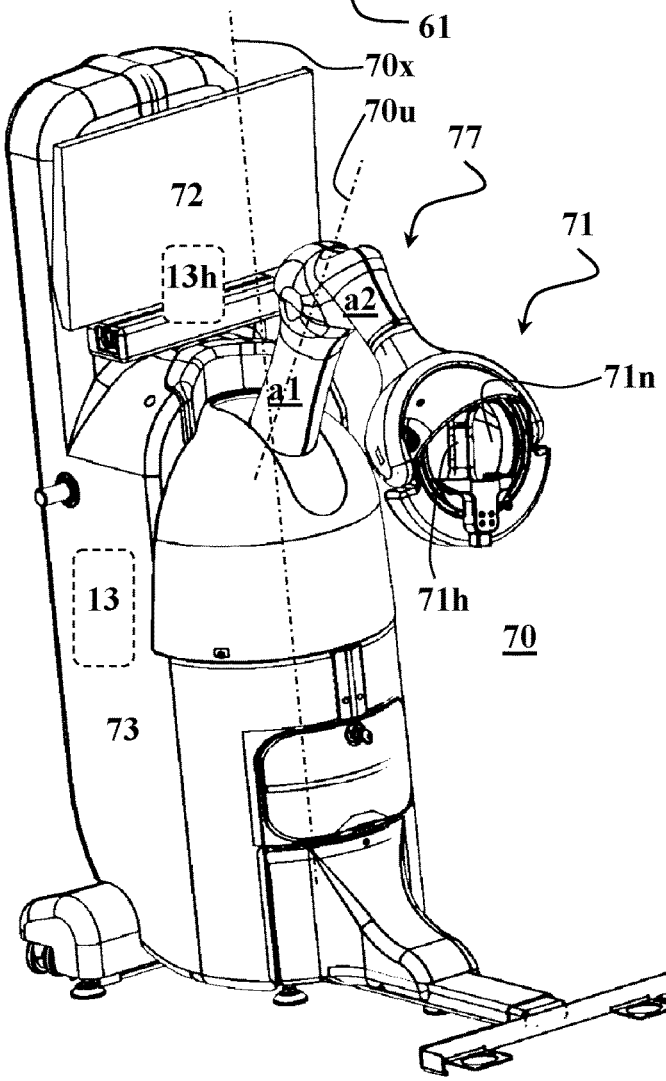
FIG. 7 schematically illustrates a motion therapy system according to some possible embodiments having a robotic arm system and a gimbal-handpiece manipulator.

FIG. 7 schematically illustrates a motion therapy system 70 according to some possible embodiments. In this specific and non-limiting example, the motion therapy system 70 comprises a portable and stabilizable training station 73 having a robotic arm 77 equipped with a gimbal-handpiece manipulator 71 at its free end. The training station 73 may further include a display device (e.g., cathode ray tube—CRT screen, liquid-crystal display—LCD display, LED display, or suchlike) 72, and the control system 13. The gimbal-handpiece manipulator 71 is a generally spherical-shaped manipulator having an internal handle/handgrip device 71*h* that is accessible via a front opening 71*n* of the manipulator 71. In operation, the treated individual (not shown) inserts one of her hands into the gimbal-handpiece manipulator 71, grips the handgrip device 71*h*, and maneuvers the manipulator 71 in three-dimensional space thereby forming trajectories intended to comply with certain tasks and/or exercises designed to train muscles and/or the central nervous system, and/or to improve daily task performance e.g., of a motor impaired individual.

Optionally, but in some embodiments preferably, the internal handle/handgrip device 71*h* is a type of treatment device configured to exercise hand function of the hand of the treated individual (e.g., hand/finger-grip and/or hand/finger-expand), such as described and illustrated in U.S. Provisional patent application No. 63/367,260 of 29 Jun. 2022, of the same Applicant hereof, the content of which is incorporate herein by reference.

The display device 72 can be a part of the HMI 13*h*, but in possible embodiments it is mainly used by the control system 13 to display to the treated individual challenging tasks and/or instructions to be performed using the gimbal-handpiece manipulator 71, and/or the progress in performing the tasks during the exercises thereby performed. For example, in a training session the treated individual can be instructed to use one of her hands to manipulate the gimbal-handpiece manipulator 71, and the state and/or location of the hand of the treated individual in a virtual environment can be presented together with other virtual objects in the display device 72, by an icon/avatar/imoji in accordance with measurement data received from various sensor devices of the system 70.

Here, the robotic arm 77 comprises first and second rotatable arms, a1 and a2, articulated one to the other. The first rotatable arm a1 can be hinged to the training station 73 for rotary movement with respect to a longitudinal/vertical axis 70*x* thereof, and the second rotatable arm a2 can be hinged to the first rotatable arm a1 for rotary movement with respect a longitudinal axis 70*u* of the first rotatable arm a1. In some embodiments the rotatable arms a1, a2 are pivoted by joints configured to provide the robotic arm 77 three-degrees of freedom (DOF) for manipulating the free end of the robotic arm 77 in the up-down, left-right, and forward-backward, directions. The gimbal-handpiece manipulator 71 is configured in some embodiments to permit the additional pitch, yaw and roll, DOF.

As better seen in FIG. 8 the first rotatable arm a1 is configured for angular motion g1 with respect to an elongated/vertical axis 70*x* of the training station 73, thereby providing the forward-backward DOF (along/parallel to the 'x'-axis) of the free end of the robotic arm 77. The first rotatable arm a1 can be further configured for rotary motion g2 about the longitudinal/vertical axis 70*x* of the training station 73, thereby providing the left-right DOF (along/parallel to the 'y'-axis) of the free end of the robotic arm 77. The second rotatable arm a2 can be connected to the first rotatable arm a1 by rotary joint 92*j* for rotary motion g3 thereof with respect to a longitudinal axis 70*u* of the first rotatable arm a1, thereby providing the up-down DOF (along/parallel to the 'y'-axis) of the free end of the robotic arm 77.

As also seen in FIG. 8, the gimbal-handpiece manipulator 71 is configured to provide one or more addition DOF to the free end of the robotic arm 77. For example, the gimbal-handpiece manipulator 71 can be configured to provide the free end of the robotic arm 77 pitch DOF/rotary motion g4 (about to the 'y'-axis), and/or yaw DOF/rotary motion g5 (about to the 'z'-axis), and/or roll DOF/rotary motion g6 (about to the 'x'-axis). This way, the motion therapy system 70 can be configured to permit six DOF motion in three-dimensional space.

In order to facilitate exercise performance by individuals whose lifting/lowering muscles are impaired and/or weak, in some embodiments the gimbal-handpiece manipulator 71 is provided with a supporting tray 71*p* configured to support the medial side of the palm (i.e., the hypothenar muscles) of treated individual. The supporting tray 71*p* is provided with sufficient surface area allowing the treated individual to comfortably rest her palm thereon and readily place the palm fingers over the handgrip device 71*h* to establish a firm grip thereover. The supporting tray 71*p* is designed to support the palm and wrist of treated individual thereon, without limiting movements of the wrist joint, to thereby enable treated individuals having impaired/weak hand lifting/lowering muscles to maintain steady continuous grip over the handgrip device 71*h*, and exercise their impaired/weak hand lifting/lowering muscles without losing hand grip over handgrip device 71*h*.

In this specific and non-limiting example, the supporting tray 71*p* is fixedly attached to the handgrip device 71*h*, to form a hand-support assembly 71*s* mechanically coupled to force/load sensor 71*f* for measuring the forces existing/evolving between the hand/arm of the treated individual and the robotic arm thereover. For example, the force/load sensor 71*f* can be fixedly attached by one (mounting) portion thereof to an internal rotating ring 71*r* of the gimbal-handpiece manipulator 71, that is responsible for the roll DOF of the robotic arm 71, and the hand-support assembly 71*s* can be fixedly attached to another/sensing portion of the force/load sensor 71*f*. This way, the forces operating/evolving between the treated individual (which is attached to/engaged with the supporting tray 71*p* and/or the handgrip device 71*h*) and the robotic arm can be immediately and simultaneously thereby measured. In some embodiments the force/load sensor 71*f* is a type of multi-axis force/torque transducer, such as, but not limited to, the nano 25 6-axis F/T sensor manufactured by ATI.

In some embodiments the handgrip device 71*h* is a generally cylindrical element vertically extending (before manipulated by the treated individual) inside the gimbal-handpiece manipulator 71. The handgrip device 71*h* comprises in some embodiments a grip sensor device 71*s* configured to generated signals/data indicative of the strength of the grip by the palm and fingers of the treated individual over the handgrip device 71*h*. The grip sensor device 71*s* can be used to implement an immobilizer for the motion therapy system 70. The control system 13 can be accordingly configured to condition some (or all) of the treatment sessions thereby conducted to receipt of signals/data from the grip sensor device 71*s* indicative of a firm/strong grip by the palm and fingers of the treated individual over the handgrip device 71*h*. The control system 13 can be further configured to halt/stop treatment sessions thereby conducted whenever the signals/data from the grip sensor device 71*s* are indicating that the grip by the palm and fingers of the treated individual over the handgrip device 71*h* becomes too loose and/or weak e.g., for the safety of treated subject, prevent injuries, and/or to simply indicate to the treated individual to improve her grip strength over the handgrip device 71*h*.

FIG. 9 shows various components of the motion therapy system 70 according to some possible embodiments. In this specific and non-limiting example the robotic arm system 77 is coupled to a turntable device 90 rotated by an axle 90*a* of an actuator (e.g., electric motor and optional power transmission means) 90*m*. An angular motion sensor device 90*s* is used in some embodiments to measure the rotary motion g2 of the turntable 90 and/or of the axle 90*a* of the robotic arm system 77, due to forces applied by the hand of the treated individual, and/or by the actuator 90*m*, and to generate respective signals/data i2 indicative thereof. The control system 13 can be configured and operable to receive and process the signals/data i2 generated by the angular motion sensor device 90*s*, and generate responsive control signals c2 for operating the actuator 90*m* to apply error regulating forces to correct or enhance errors of the treated individual during treatment sessions thereby performed. It is noted that in possible embodiments the robotic arm system 77 can be directly connected to the axle 90*a* of the actuator 90*m* i.e., without the turntable device 90.

The rotatable arm a1 can be coupled to the turntable 90 (or axle 90*a*) via a rotary motion joint 91*j* configured to permit the rotary motion g1 of the rotatable arm a1 with respect to the longitudinal/vertical axis 70*x* of the motion therapy system 70. Actuator (e.g., electric motor and optional power transmission means) 91*m* is used in some embodiments to rotate the rotatable arm a1 with respect to the longitudinal/vertical axis 70*x*. An angular motion sensor device 91*s* can be used to measure the rotary motion g1 of the rotatable arm a1 of the robotic arm system 77, due to forces applied by the hand of the treated individual, and/or by the actuator 91*m*, and to generate respective signals/data i1 indicative thereof. The control system 13 can be configured and operable to receive and process the signals/data i1 generated by the angular motion sensor device 91*s*, and generate responsive control signals c1 for operating the actuator 91*m* to apply error regulating forces to correct or enhance errors of the treated individual during treatment sessions thereby performed.

The rotatable arm a2 can be coupled to the rotatable arm a1 via a rotary motion joint 92*j* configured to permit the rotary motion g3 of the rotatable arm a2 with respect to the longitudinal axis 70*u* of the rotatable arm a1. Actuator (e.g., electric motor and optional power transmission means) 92*m* is used in some embodiments to rotate the rotatable arm a2 with respect to the longitudinal axis 70*u* of the rotatable arm a1. An angular motion sensor device 92*s* can be used to measure the rotary motion g3 of the rotatable arm a2 of the robotic arm system 77, due to forces applied by the hand of the treated individual, and/or by the actuator 92*m*, and to generate respective signals/data i3 indicative thereof. The control system 13 can be configured and operable to receive and process the signals/data i3 generated by the angular motion sensor device 92*s*, and generate responsive control signals c3 for operating the actuator 92*m* to apply error regulating forces to correct or enhance errors of the treated individual during treatment sessions thereby performed.

Optionally, but in some embodiments preferably, the gimbal-handpiece manipulator 71 is fixedly attached to the free end of the rotatable arm a2. As exemplified in FIG. 9, the force/load sensor 71*f* is used in some embodiments to connect/attach the handgrip device 71*h* and the supporting tray 71*p* i.e., the hand-support assembly 71*s*, to the gimbal-handpiece manipulator 71 e.g., the force/load sensor 71*f* is fixedly attached to the internal rotating ring 71*r* of the gimbal-handpiece manipulator 71 by a securing/stabilizing portion thereof and attached to the hand-support assembly 71*s* by a transducer sensitive portion thereof.

The force/load sensor 71*f* can be a multi-axis sensor device configured to measure forces operating/evolving between the exercised body portion (e.g., the arm and/or hand) of the treated individual and the robotic arm and/or the hand-support assembly 71*s* (e.g., support tray 71*f* and/or the handgrip device 71*h*) in all directions associated with the pitch g4, and/or yaw g5, and/or roll g6, directions, and generate signals/data i4 indicative thereof. The control system 13 can be configured and operable to receive and process the signals/data i4 generated by the force/load sensor 71*f*, and generate responsive control signals c1, and/or c2, and/or c3, for respectively operating the actuators 90*m*, and/or 91*m*, and/or 92*m*, to apply error regulating forces to correct or enhance errors of the treated individual during treatment sessions thereby performed.

As also seen in FIG. 9, in some embodiments the control system 13 is configured and operable to implement an operation immobilizing module 13*w* for selectively enabling or disabling operation of the system 70, responsive to signals/data i5 generated by the grip sensor device 71*s*. For example, but without being limiting, the immobilizing module 13*w* can be configured to disable the operation of the drivers control module 23 whenever the signals/data from the grip sensor device 71*s* are indicative of loose/weak grip of the palm and fingers of the treated subject over the internal handle/handgrip device 71*h* of the gimbal-handpiece manipulator 71.

Optionally, but in some embodiments preferably, the control system 13 comprises a zero-gravitation module 13*z* configured and operable to operate the drivers control module 23 to continuously generate control signals c1, and/or c2, and/or c3, for maintaining the free end of the robotic arm system at the same height e.g., responsive signals/data i1, and/or i2, and/or i3, generated by the sensors 90*s*, and/or 91*s*, and/or 92*s*, respectively. In the zero-gravitation mode the free end of the robotic arm system 77 engaged with the palm and fingers of the treated individual is continually maintained in a floating-like state due to counter-gravitation forces applied by the different actuators of the system i.e., the actuators continuously apply elevating forces configured to cancel the weight of the arm and hand of the treated individual. The HMI unit 13*h* can be accordingly adapted to permit the operator of the system 70 to selectively turn ON or OFF the zero gravitation module 13*z* e.g., in order to facilitate use of the system 70 by individuals having impaired/weak lifting/lowering muscles.

The zero gravitation control of the zero gravitation module 13*z*, and/or the immobilizing operation of the immobilizing module 13*w*, can be similarly applied in all other motion therapy system embodiments disclosed herein.

It should be understood that throughout this disclosure, where a process or method is shown or described, the steps of the method may be performed in any order or simultaneously, unless it is clear from the context that one step depends on another being performed first.

As described hereinabove and shown in the associated figures, the present invention provides error regulating techniques usable for motor impairment therapy and related methods and systems. While particular embodiments of the invention have been described, it will be understood, however, that the invention is not limited thereto, since modifications may be made by those skilled in the art, particularly in light of the foregoing teachings. As will be appreciated by the skilled person, the invention can be carried out in a great variety of ways, employing more than one technique from those described above, all without exceeding the scope of the claims.

The invention claimed is:

1. A system for use in improving individual's motion ability, the system comprising:

a force applying device configured to controllably apply adaptable forces in real-time to at least portion of the individual's body during an exercise performed by the individual;

a sensing system configured to monitor one or more training sessions of the exercise performed by said at least portion of the individual's body and selectively generate first measurement data comprising error-related data indicative of deviations of said at least portion of the individual's body from a desired trajectory, velocity and/or acceleration, and/or second measurement data indicative of adaptive response of the individual to the force applied to said at least portion of the individual's body; and a control system configured for data communication with the sensing system and with the force applying device, the control system comprising:

a force controller configured to manage operation of the force applying device according to operational data such that the force being applied to the at least portion of the individual's body includes at least one interfering force segment for which error augmenting forces are applied in real-time by the force applying device, determined in accordance with a predetermined range of an error regulating profile and direction, velocity and/or acceleration, of motion applied by the at least portion of the individual's body and derived from the first and/or the second measurement data from the sensing system;

an analyzer configured to selectively perform in real-time the following: (i) provide force adjustment data indicative of a maximal applicable force value for said error regulating profile, based at least partially on individual-related data in association with the exercise; (ii) analyze at least one of the first and second measurement data to determine an average error value and determine based on said average error value at least one slope of an error-augmenting function or of an error-correcting function of the error regulating profile, and generate the operational data to the force controller accordingly.

2. The system according to claim 1, wherein the analyzer is configured to determine based on the analyzed measurement data one or more average error values and respective one or more local maximal forces applied by the at least portion of the individual's body and/or an optimal adaptive force response of the individual to the exercise thereby performed, and determine based thereon at least one slope of an error-augmenting function or of an error-correcting function of the error regulating profile.

3. The system according to claim 1, comprising at least one sensor device configured for determining a motion pattern characterizing the individual's performance of the training session, and, upon identifying an error in said motion pattern, measuring the error and generating the first measurement data comprising the error-related data.

4. The system according to claim 1 wherein the sensing system comprising at least one of the following: a positioning sensor device, a velocity sensor device; an acceleration sensor device, a force sensor device, an ammeter configured to measure electric current of an electric motor in the force applying device, electromyograph (EMG), surface EMG, and/or intramuscular EMG, configured to determine patterns characterizing the individual's performance of the training session.

5. The system according to claim 1, wherein the sensing system comprises one or more sensors configured to determine a response force of said at least portion of the individual's body to the force being applied thereto and generate the second measurement data indicative of adaptive response of the individual.

6. The system according to claim 5, wherein said one or more sensors are configured to directly measure the response force of said at least portion of the individual's body to the force being applied thereto and/or measure the response force via its effect on one or more parameters or conditions of an operative device being operated by the individual during the training session.

7. The system according to claim 1 wherein the error regulating profile comprises at least one of the following: at least one error augmenting portion defining a range of error values associated with the exercise performed by the at least portion of the individual's body, for which error augmenting forces are applied by the force applying device; at least one error correcting portion defining a range of error values associated with the exercise performed by the at least portion of the individual's body, for which error correcting forces are applied by the force applying device; at least one dead band portion defining a range of error values for which forces are not applied by the force applying device; at least one transition portion defining a range of error values between the at least one dead band portion and the at least one error augmenting portion of the error regulating profile, for which the forces applied by the force applying device are progressively changed in accordance with the transition between said dead band and error augmenting portions; at least one transition portion defining a range of error values between the at least one dead band portion and the at least one error correcting portion of the error regulating profile, for which the forces applied by the force applying device are progressively changed in accordance with the transition between said dead band and error correction portions.

8. The system according to claim 7 wherein the at least one error augmenting portion comprises at least one constant error augmenting range defining a sub-range of error values associated with the exercise performed by the at least portion of the individual's body, for which the error augmenting forces applied by the force applying device are constant, and/or wherein the at least one error correcting portion comprises at least one constant error correcting range defining a sub-range of error values associated with the exercise performed by the at least portion of the individual's body, for which the error correcting forces applied by the force applying device are constant.

9. The system according to claim 1 wherein the error regulating profile comprises at least one control function defining an attenuation profile for the error regulating profile in accordance with relative progress of movement performed by the at least portion of the individual's body.

10. The system according to claim 7 wherein at least one of the at least one error augmenting portion, the at least one constant error augmenting range, the at least one error correcting portion, the at least one constant error correcting range, the at least one dead band portion, the at least one transition portion, and/or the at least one control function, are determined by the analyzer based on the first and/or second measurement data, and/or the individual-related data, and/or based on user's data inputs.

11. The system according to claim 1 comprising a database for storing individual-related data, and/or the force adjustment data, and/or the error regulating profile.

12. The system according to claim 1 wherein the force applying device comprises: one or more motor actuatable arms configured for allowing movement of a hand of the treated individual in at least one of up-down, left-right, and/or forward-backward, directions; a supporting tray coupled to the system and configured to support palm and wrist of the hand of the treated individual; and a handgrip device coupled to said supporting tray and configured for gripping by the palm and fingers of the hand of the treated individual, to thereby facilitate exercise performance by motor impaired individuals.

13. The system according to claim 12 comprising at least one of the following: a force sensor configured to measure forces operating between the at least portion of the individual's body and the one or more motor actuatable arms, wherein said force sensor is connecting said handgrip device and/or the supporting tray to the one or more motor actuatable arms; a grip sensor device in the handgrip device configured to sense grip strength of the palm and fingers of the treated individual over said handgrip device and generate data/signals indicative thereof; a gimbal-handpiece manipulator attached to the free end of the robotic arm system and configured to enable at least one of pitch, yaw and roll, motion by the handgrip device.

14. The system according to claim 12 wherein the control system comprises an immobilizing module configured to halt operation of the system responsive to signals/data from the grip sensor device, and/or a zero-gravitation module configured to operate the force applying device to apply counter-gravitation forces over the free end of the robotic arm system.

15. A method for improving individual's motion ability, the method comprising:

determining force adjustment data based at least in part on individual-related data, said force adjustment data being indicative of a maximal applicable force value applicable to at least a portion of the individual's body for limiting error augmenting forces of a predetermined error regulating profile associated with an exercise performed by the individual;

generating first measurement data comprising error-related data indicative of deviations of said at least portion of the individual's body from a desired trajectory, velocity and/or acceleration associated with said exercise, and second measurement data indicative of adaptive response of the individual to the force applied to said at least portion of the individual's body during the exercise; and analyzing at least one of the first and second measurement data to determine an average error value, and determining based on said average error value at least one slope of an error-augmenting function or of an error-correcting function of the error regulating profile and its maximal applicable force value, and generating in real-time operational data for effecting said error augmenting forces to apply the force within said range of the error regulating profile.

16. The method according to claim 15 comprising analyzing the measurement data and performing at least one of the following: determining one or more average error values and respective one or more local maximal forces applied by the at least portion of the individual's body, and determining based thereon at least one slope of an error augmenting function or of an error-correcting function of the error regulating profile; determining an average error value and an optimal adaptive force response of the individual to the exercise thereby performed, and determining based on said average error value and optimal adaptive force response at least one slope of an error augmenting function, or of an error-correcting function, of the error regulating profile; defining or adjusting the maximal applicable force value and/or at least one parameter of the error regulating profile.

17. The method according to claim 16 comprising defining or adjusting based on the processed measurement data at least one of the following: at least one error augmenting portion of the error regulating profile in which the error augmenting force is to be applied over the at least portion of the individual's body; at least one constant error augmenting range defining a sub-range of error values within the error augmenting portion in which a constant error augmenting force is to be applied over the at least portion of the individual's body; at least one error correction portion of the error regulating profile in which error correcting forces are to be applied over the at least portion of the individual's body; at least one constant error correction range defining a sub-range of error values within the error correction portion in which a constant error correcting force is to be applied over the at least portion of the individual's body.

18. The method according to claim 16 comprising defining or adjusting based on the processed measurement data: at least one dead band portion of the error regulating profile in which forces are not applied over the at least portion of the individual's body; or at least one transition portion of the error regulating profile in which forces applied over the at least portion of the individual's body progressively change in accordance with changes of error values of the error-related data.

19. The method according to claim 16 comprising: determining based on the error-related data an average error value for performance of the exercise without application of error regulating forces; processing the measurement data comprising the error-related data in association with the individual's performance of an exercise performed with the error regulating forces applied in accordance with the error regulating profile, and determining based thereon at least one of adaptive response of the individual and an average error value for performance of the exercise with application of the error regulating forces; adjusting the determined maximal applicable force value based on a comparison between the determined average error value for performance of the exercise with and without application of the error regulating forces.

20. The method according to claim 19 comprising processing the measurement data comprising the error-related data indicative of deviations of the at least portion of the individual's body from a desired trajectory of a further exercise performed with error regulating forces applied in accordance with the error regulating profile, and determining based thereon at least one of adaptive response of the individual and an average error value for performance of the exercise with application of error regulating forces.

21. The method according to claim 20 comprising repeating the processing of the measurement data comprising the error-related data in association with the individual's performance of the further exercise performed with the error regulating forces applied in accordance with the error regulating profile until either: (i) the determined adaptive response and/or average error value for performance of the exercise with application of the error regulating forces is indicative of an acceptable progress level in performance of the exercise; or (ii) a number of times the exercise performed with the application of the error regulating forces equals a predetermined number.

22. The method according to claim 15 comprising defining a control function configured to progressively attenuate the error regulating forces applied to the at least portion of the individual's body during the exercise with respect to a distance from the body of said individual.

23. A method for determining competence of an individual to a motion improving treatment, the method comprising:

providing an error regulating profile defining at least one interfering force segment in which error augmenting forces are applied over at least one body portion of said individual during performance of an exercise, and a maximal applicable force value limiting the error augmenting forces of said error regulating profile;

measuring error-related data indicative of deviations of the at least portion of the individual's body from a desired trajectory, velocity and/or acceleration, associated with an exercise without application of the error regulating forces defined by said error regulating profile, and determining an average error value for exercise performance without application of error regulating forces based thereon;

measuring error-related data in association with the individual's performance of the exercise with real-time application of the error regulating forces defined by said error regulating profile, and determining an average error value for exercise performance with real-time application of error regulating forces based thereon; and determining said competence based on a relation between the average error values determined for exercise performance with and without the error regulating forces.

24. The system according to claim 1 wherein the at least one interfering force segment for which error augmenting forces are applied in real-time by the force applying device is determined in accordance with a predetermined range of an error regulating profile and directions of forces applied by the at least portion of the individual's body and derived from the first and/or the second measurement data from the sensing system.

* * * * *